US009696041B2

(12) United States Patent
Moro et al.

(10) Patent No.: US 9,696,041 B2
(45) Date of Patent: Jul. 4, 2017

(54) CONTROL DEVICE FOR GAS TAPS

(71) Applicant: ELTEK S.p.A., Casale Monferrato (Alessandria) (IT)

(72) Inventors: Marco Moro, Casale Monferrato (IT); Paolo Savini, Casale Monferrato (IT)

(73) Assignee: ELTEK S.p.A., Casale Monferrato (Alessandria) (IT)

( * ) Notice: Subject to any disclaimer, the term of this patent is extended or adjusted under 35 U.S.C. 154(b) by 270 days.

(21) Appl. No.: 14/403,879

(22) PCT Filed: May 24, 2013

(86) PCT No.: PCT/IB2013/054298
§ 371 (c)(1),
(2) Date: Nov. 25, 2014

(87) PCT Pub. No.: WO2013/175438
PCT Pub. Date: Nov. 28, 2013

(65) Prior Publication Data

US 2015/0153047 A1 Jun. 4, 2015

(30) Foreign Application Priority Data

May 25, 2012 (IT) ..... TO2012A0455

(51) Int. Cl.
*F23N 5/10* (2006.01)
*F24C 3/12* (2006.01)
(Continued)

(52) U.S. Cl.
CPC ..... *F24C 3/126* (2013.01); *F23N 1/007* (2013.01); *F23N 5/107* (2013.01); *F23N 5/203* (2013.01); *F24C 3/085* (2013.01)

(58) Field of Classification Search
CPC ..... F24C 3/126; F24C 3/085; F23N 1/007; F23N 5/203; F23N 5/107
(Continued)

(56) References Cited

U.S. PATENT DOCUMENTS 5,575,638 A * 11/1996 Witham ..... F23N 5/203 126/39 BA
5,813,320 A * 9/1998 Frasnetti ..... F24C 3/126 126/39 G
(Continued)

FOREIGN PATENT DOCUMENTS

WO WO 2010/134040 11/2010
WO WO 2011/096902 8/2011

OTHER PUBLICATIONS

International Search Report for PCT/IB2013/054298, mailed Nov. 7, 2013.
(Continued)

*Primary Examiner* — Sean Michalski
(74) *Attorney, Agent, or Firm* — Nixon & Vanderhye P.C.

(57) ABSTRACT

A control device for gas appliances comprises:
- a manual-control element (22), which can be turned about a first axis (A) for setting a time interval;
- a circuit arrangement (25) that includes a sensor device, configured for detecting movements of the manual-control means (22); and
- a supporting structure (21), which can be associated in a stationary way to a gas tap (10), the supporting structure (21) being designed for being mounted within a body of a gas appliance.

At least one of the manual-control element (22) and the supporting structure (21) has an axial cavity or defines at least part of a passage, where there can be received a corresponding part of the gas tap (10).
(Continued)

A part of the sensor device is movable with respect to a second axis (B), and operatively set between the manual-control element (22) and the movable part of the sensor device is a transmission arrangement (28-30).

20 Claims, 17 Drawing Sheets

(51) Int. Cl.
*F23N 1/00* (2006.01)
*F23N 5/20* (2006.01)
*F24C 3/08* (2006.01)

(58) Field of Classification Search
USPC ..... 99/332, 327, 328, 333, 337, 341
See application file for complete search history.

(56) References Cited

U.S. PATENT DOCUMENTS 6,705,533 B2 * 3/2004 Casey ..... F23N 1/002 236/1 E
7,467,639 B2 * 12/2008 Watson ..... F23N 1/002 137/1
2002/0094498 A1 7/2002 Rodriguez-Rodriguez et al.
2006/0151996 A1 * 7/2006 Lang ..... F16L 9/006 285/197
2006/0234177 A1 * 10/2006 Yu ..... F23N 5/22 431/86
2011/0126823 A1 * 6/2011 Barritt ..... F23N 1/002 126/39 BA
2013/0199512 A1 * 8/2013 Cetintas ..... F23N 5/24 126/39 BA
2014/0047944 A1 * 2/2014 Camli ..... F24C 3/126 74/553
2014/0150773 A1 * 6/2014 Daughtridge, Jr. ..... F24C 3/124 126/39 E
2014/0252880 A1 * 9/2014 Seigler ..... H03K 17/94 307/116
2015/0198336 A1 * 7/2015 Koch ..... F23N 5/245 126/39 E
2016/0061454 A1 * 3/2016 Wei ..... F23N 1/005 99/332

OTHER PUBLICATIONS

Written Opinion of the International Searching Report for PCT/IB2013/054298, mailed Nov. 7, 2013.

* cited by examiner

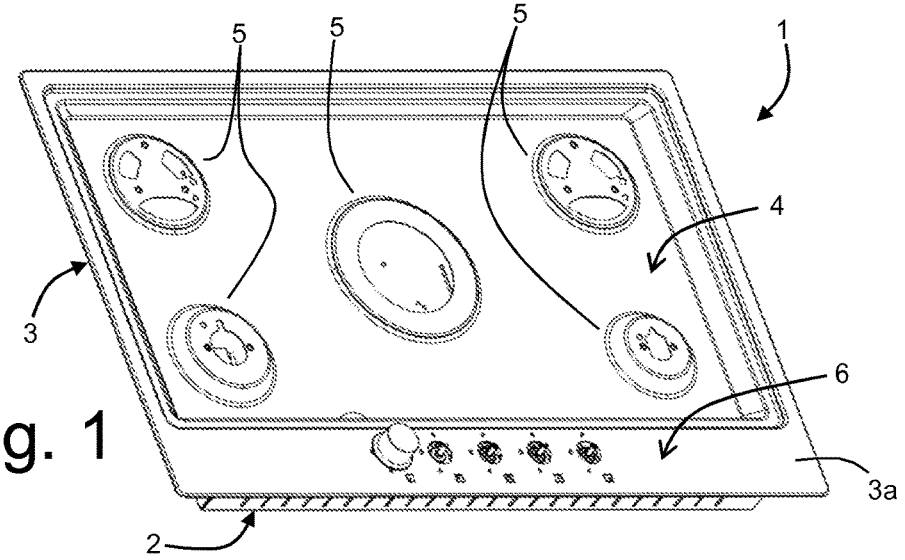
Fig. 1
Fig. 2
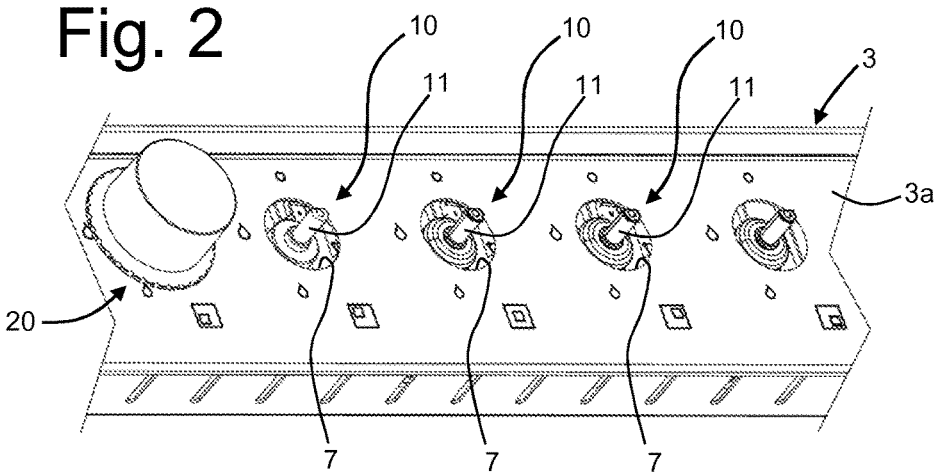
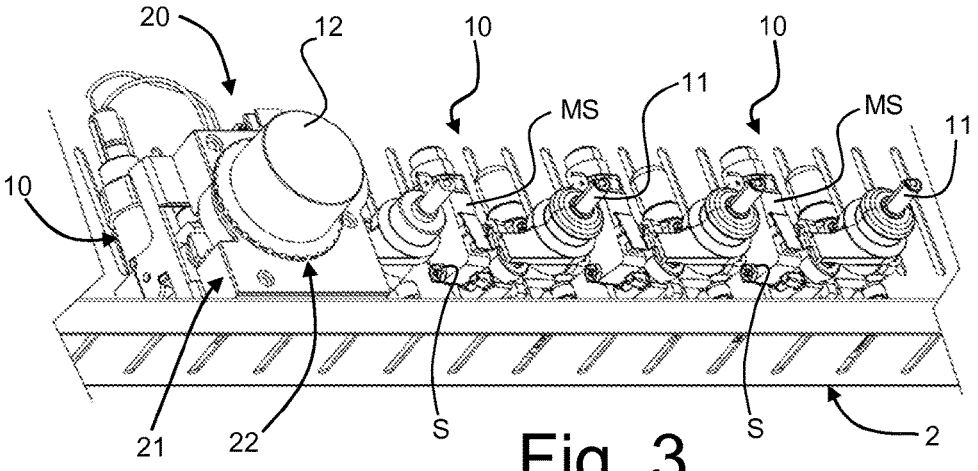
Fig. 3

CONTROL DEVICE FOR GAS TAPS

This application is the U.S. national phase of International Application No. PCT/IB2013/054298, filed 24 May 2013, which designated the U.S. and claims priority to IT Application No. TO2012A000455, filed 25 May 2012; the entire contents of each of which are hereby incorporated by reference.

FIELD OF THE INVENTION

The present invention relates to devices for control of the supply of gas for appliances having one or more gas burners or similar flame generators. More in particular, the invention regards a control device having a timing function, aimed at enabling setting and/or adjustment of a desired time interval of supply of gas to a respective burner or the like.

PRIOR ART

Gas taps commonly used in cooking appliances and the like have a body, generally made of metal, provided with an inlet for connection to a gas-supply line, and an outlet for connection to a duct for delivery of the gas to the burner controlled by the tap. Mounted within the tap body are means for adjusting the flow of gas, constituted, for example, by an open/close element or partializer that can be position-adjusted via a manoeuvring rod and/or further levers or internal mechanisms. The rod projects axially from a proximal end of the tap body and is designed to turn about its own axis, for the purposes of the aforesaid flow adjustment. Coupled to the manoeuvring rod is a knob: a rotation imparted manually on the knob hence brings about rotation of the rod and consequent flow adjustment.

Provided within the tap body is a safety valve, which can be kept in the respective open condition by an electromagnet, the valve being of the open-closed type, for enabling or preventing, respectively, the flow of gas to the burner. The electromagnet is supplied via a thermo-electric generator, typically constituted by a thermocouple connected to a corresponding attachment or electrical connector of the tap body. The opposite end of the thermocouple, i.e., its sensitive part or hot junction, is installed in the proximity of the burner controlled by the tap. When the burner is lit, the sensitive part of the thermocouple generates an electromotive force (e.m.f.) in response to the heat generated by the flame to the burner, which determines a current that supplies the electromagnet of the safety valve, such as to keep the open-close element of the latter (associated to a movable core attracted by the electromagnet) in the respective open condition, countering the action of a spring.

Basically, as long as the burner is lit, the thermocouple generates a current that enables the electromagnet to keep the valve open; when the burner is turned off manually, or goes out accidentally, the electrical supply to the electromagnet ceases and the valve closes, forced in this direction by the aforesaid spring so as to prevent passage of gas between the inlet and the outlet of the tap.

For the aforesaid reasons, the rod of the tap is able to translate along its own axis, in a direction of actuation, against the action of elastic means inside the tap body. This axial displacement can be obtained by pushing the knob of the tap and turning it. With this movement there occurs both an initial opening of the safety valve and the flow of gas to the burner, and the knob is kept in the pressed condition until the flame is lit on the burner. As has been said, in the presence of the flame, the thermocouple generates the current, which, via the electromagnet, keeps the valve in the open condition. Hence, after ignition of the flame, the user can release the knob.

Operatively associated to the tap there may also be a gas-lighter system, for generating sparks in the proximity of the burner in order to cause ignition of the flame. This system usually comprises an electrical circuit that includes electrodes, generated between which are the aforesaid sparks following upon an electrical discharge. In some gas appliances, the lighter system is activated by exploiting the configuration of the tap, and especially the possibility of its rod translating axially. Consequently, by pressing the knob of the tap after turning it at least slightly, in addition to determining initial opening of the safety valve and flow of gas to the burner, the lighter system is also activated.

For this purpose, generally associated to the rod of the tap is an actuation element, which, in the course of axial displacement of the rod, causes switching of a microswitch of a normally open type, belonging to the electrical circuit of the lighter system. The microswitch may be of a type commonly available on the market for various uses and is anchored directly to the body of the tap, which has for this purpose at least one threaded hole for a corresponding fixing screw.

To a gas tap of the type referred to previously there may be associated a device for timed control of the supply of gas to a corresponding burner, i.e., to enable setting of a desired time interval of operation of the burner.

Timer devices are known, operatively coupled to a respective gas tap and having a corresponding knob, substantially coaxial to the knob of the tap. Via the knob of the device, a user can set a desired time interval of supply and then light the burner. Upon expiry of the time interval set, the device brings about closing of the safety valve inside the tap so as to interrupt supply of gas to the burner. For this purpose, the known device integrates a control circuit arrangement that basically includes timer means, which can be set via the corresponding knob, and controllable electrical switching means, connected between the thermocouple and the electromagnet of the safety valve of the gas tap. In a possible embodiment, the circuit arrangement of the known device also includes controllable electrical switching means connected in series to the circuit of the lighter system, designed to perform the functions of the microswitch previously referred to provided on taps of a traditional type.

SUMMARY OF THE INVENTION

In its general terms, the object of the present invention is to provide a control device of the type indicated having improved structure and functions as compared to the prior art, and, in particular, a device that is compact and inexpensive to produce, easy to assemble, and of contained cost, high reliability, and convenience of use.

The above and other objects still, which will emerge more clearly hereinafter are achieved according to the present invention by a control device for gas appliances, in particular appliances that comprise at least one gas tap having a safety valve that includes an electromagnet that can be supplied via a thermo-electric generator.

Preferably the control device comprises at least one from among:

- manual-control means;
- a circuit arrangement that includes:
  - control means;
  - electrical-interconnection means;

sensor means, configured, in particular, for detecting actuation of the manual-control means and supplying corresponding signals to the control means; and a supporting structure that can be associated in a stationary way with respect to a gas tap, the supporting structure being designed for being mounted within a body of the gas appliance, wherein the control means are, in particular, configured for modifying the state of an electrical connection upon expiry of the aforesaid time interval.

The device according to the invention is distinguished by the presence of structural elements configured for improving at least one from among:

coupling of the manual-control means to the sensor means;

coupling of the supporting structure of the device to the gas tap and/or to the body of the gas appliance;

coupling of means for actuation of the gas tap to the control device, and, in particular, to its circuit arrangement;

notification of information to a user;

coupling of optical elements, in particular between the inside and the outside of the body of the gas appliance; and housing of the circuit arrangement and/or support of at least part of the control members with respect to a casing of the device.

Preferential characteristics of the control device according to the invention are specified in the claims, which form an integral part of the technical teaching provided herein in relation to the invention.

BRIEF DESCRIPTION OF THE DRAWINGS

Further purposes, characteristics, and advantages of the present invention will emerge clearly from the ensuing detailed description and from the annexed drawings, which are provided purely by way of explanatory and non-limiting example and in which:

FIG. 1 is a schematic perspective view of a gas-supplied appliance provided with a control device according to a possible embodiment of the invention;

FIG. 2 is a detail of FIG. 1;

FIG. 3 is a view similar to that of FIG. 2, but with a part of the appliance removed;

DESCRIPTION OF PREFERRED EMBODIMENTS OF THE INVENTION

Figure 4:
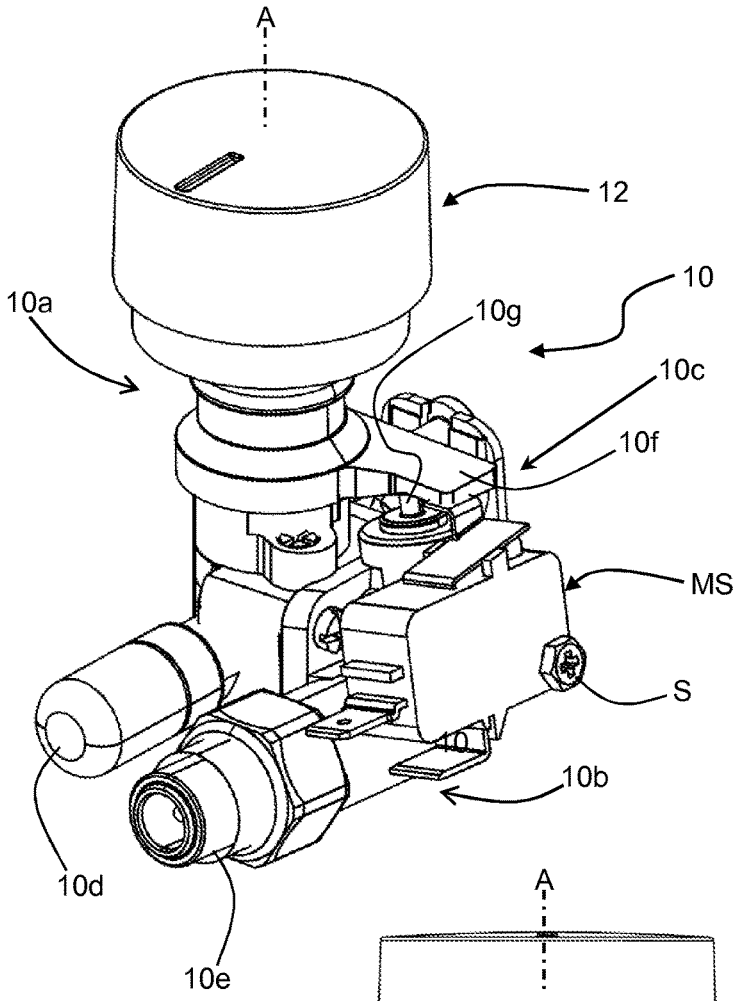
FIGS. 4 and 5 are a perspective view and a view in side elevation of a known gas tap, provided with a switch forming part of a gas-lighter system of a gas-supplied appliance.

FIG. 1 is a schematic representation of a gas-supplied appliance 1, equipped with a control device according to the present invention, hereinafter also defined for ready reference as "timer device".

In the example illustrated, the appliance 1 is a cooking appliance, and more in particular a cooking hob, of a general conception in itself known, of which just the elements useful for an understanding of the invention are represented. The timer device according to the invention may in any case also be used in other types of appliances provided with at least one gas burner, or similar flame generator, controlled via a respective tap, such as for example boilers, in particular for domestic heating.

The structure or body of the appliance 1 includes a lower box 2, which is fixed to an upper lid 3, defining a working area 4 identified in which are various cooking locations 5, as well as a command area 6. As per the known art, mounted within the structure of the appliance 1 are various functional components, amongst which—for what is of interest herein—taps for control of the supply of gas to the burners (not represented in detail herein)—of the various cooking locations 5. For this purpose, as may be noted in FIG. 2, a wall 3*a* of the lid 3 has—in a position corresponding to the command area 6—a series of through openings 7, projecting from each of which is the actuation rod 11 of the tap 10 of a corresponding burner. As may be appreciated from FIG. 3, the taps 10 are fixed within the structure of the appliance, in positions corresponding to the openings 7, all according to the known art. The taps 10 are of a type in itself known, in particular of the type described in the introductory part of the present description.

By way of example, in the example of embodiment represented, only one of the taps 10 is equipped with a timer device provided according to the invention, designated as a whole by 20. Once again by way of example, the four taps 10 of FIG. 3 not equipped with the device 20 are provided with traditional pushbutton microswitches, some of which are designated by MS, of the type traditionally belonging to the electrical circuit of a gas-lighter system. The microswitches MS are fixed with a screw S to the corresponding tap body.

Figure 5:
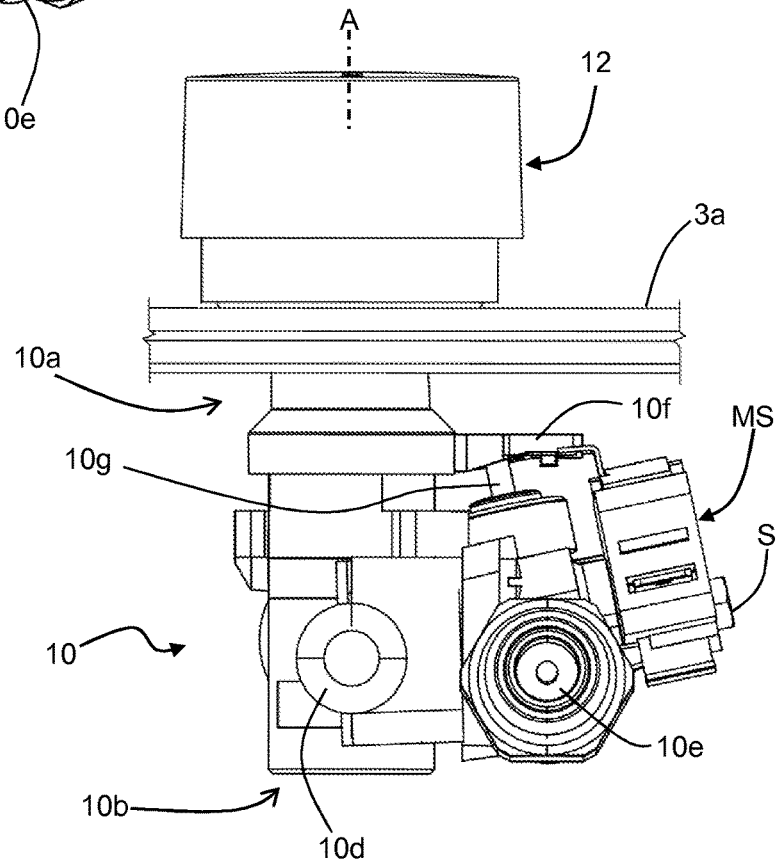

FIGS. 4 and 5 exemplify a gas tap 10 of a type generally known on the market, as described in the introductory part of the present description. In general terms, the body of the tap 10 has a front portion 10*a*, projecting from which is the corresponding rod 11—here not visible in so far as it is engaged by the corresponding control knob 12, but which extends along the axis designated by A—and a rear portion 10*b*, provided in which are the inlet and the outlet for the gas, as well as the attachment for the thermocouple, where the front portion 10*a* has overall dimensions generally small with respect to the rear portion 10*b*. In FIGS. 4 and 5 the inlet and outlet for the gas are designated by 10*c* and 10*d*, whilst the attachment for the thermocouple is designated by 10*e*. In the case of the tap 10 illustrated also visible is an actuation element 10*f*, operatively constrained to the corresponding control rod to move therewith only in an axial direction, according to a technique well known in the sector. In practice, the element 10*f* is coupled to the rod so that, when this is turned about the axis A, the element 10*f* remains substantially stationary. When, instead, the rod 11 is translated axially along the axis A, the element 10*f* follows the axial movement of the rod. With said axial movement—and in particular when the rod is pressed by means of the knob 12—the element 10*f* pushes a shaft 10*g*, which brings about opening of the safety valve of the tap 10, as explained previously, said valve being then kept open thanks to the corresponding electromagnet, once the flame of the burner has been lit. When the user releases the knob 12, the actuation element 10*f* follows the movement of axial return of the control rod.

In traditional applications, as has been said, the actuation element 10*f* can be advantageously exploited also for causing switching in closing of a microswitch MS forming part of the lighter system, which is fixed to the body of the tap via the screw S, typically a microswitch connected to the a.c. voltage of a domestic electrical wiring system, such as a 220-V a.c. voltage.

Figure 6:
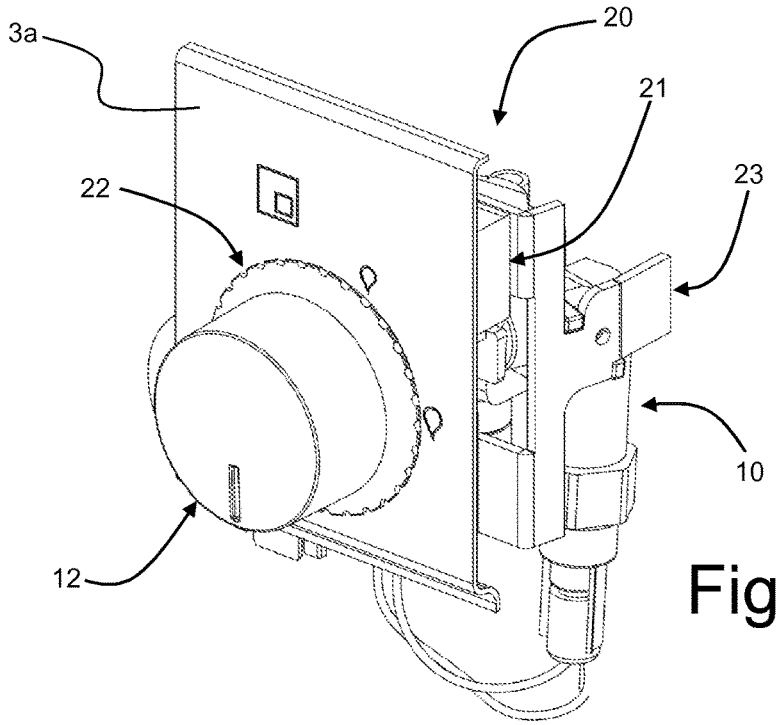
FIG. 6 is a partial and schematic perspective view of a control device according to the invention, in a condition where it is installed on the appliance.
Figure 7:
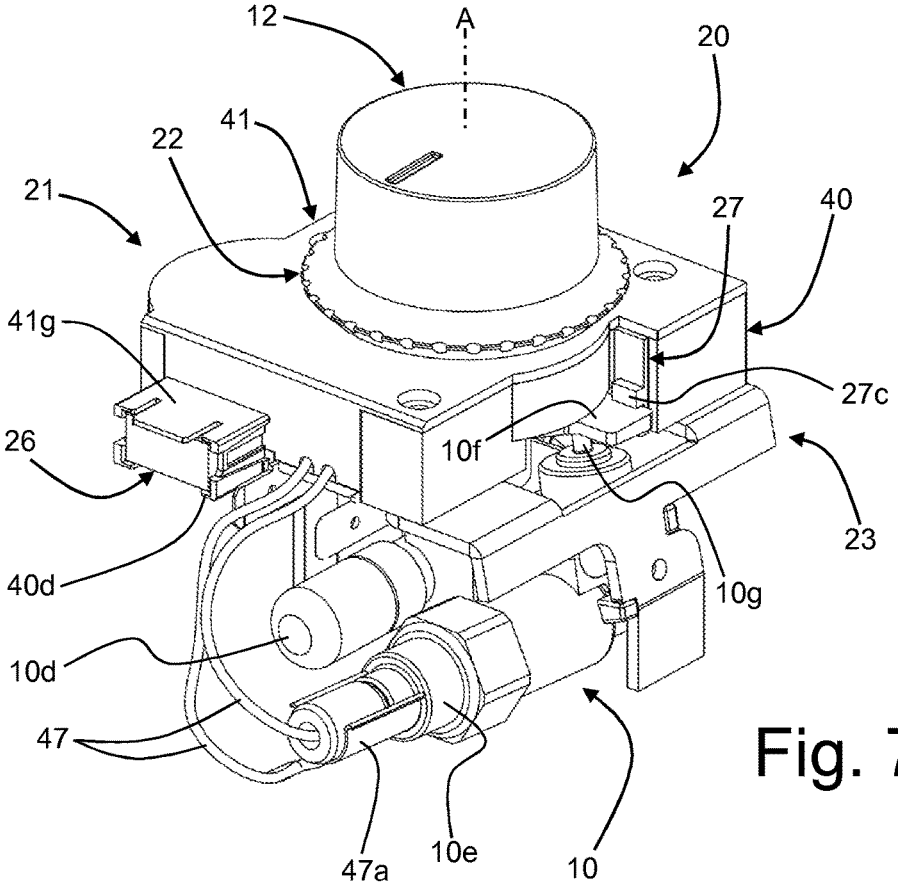
FIG. 7 is a partial and schematic perspective view of the device of FIG. 9, but from a different angle and with a part of the appliance removed.

Visible in FIGS. 6 and 7 is a timer device 20 according to a possible embodiment of the invention. The supporting structure of the device 20 comprises a boxlike casing 21—for housing at least part of a corresponding circuit arrangement and a mechanical-transmission arrangement—as well as a command means 22 for setting at least one time of supply of gas to the burner controlled by the corresponding tap 10. In the condition where the device 20 is assembled on the appliance (FIG. 6), the casing 21 is housed within the structure 2-3, and hence in a concealed position, with just the command means 22 accessible from outside. Preferably, the casing 21 is set between a rear portion of the tap 10 and the wall 3*a* of the structure provided with the opening projecting from which is at least the actuation rod 11. Very preferably, the casing 21 is shaped so as to receive through it at least part of a front portion of the tap 10. For this purpose, in a preferred embodiment, the casing 21 is shaped so as to define a passage, inserted within which is the aforesaid front portion of the tap. As will be seen hereinafter, in one embodiment, various components of the device 20 (such as the ones designated hereinafter by 25, 40 and 41) are purposely configured for determining the presence of the aforesaid passage.

In a preferred embodiment, the command means 22 comprises a ring nut member or knob, which is operatively set between a knob 12 for manual actuation of the rod 11 of the tap 10 and the outer face of the wall 3*a*. In the assembled condition of the device 20, the command means 22—hereinafter referred to for simplicity as "ring nut"—is mounted movable, in particular angularly movable or rotatable, and is basically coaxial to the knob 12. In one embodiment (not represented), the ring nut 22 may also be axially movable, for example in order to bring about switching of control elements of the tap 10 and/or of the device 20. Of course, the shape and proportions of the ring nut 22 as represented, with respect to the knob 12, are merely indicative.

In a preferred embodiment, the ring nut 22—which can function as light guide for performing also light-warning functions—represents the only component of the device 20 that is visible and operable from outside the structure of the appliance 1. In other possible embodiments, from the outside of the aforesaid structure there may be noted at least partially also other components of the device 20, for example a light-warning element.

In a preferred embodiment, the structure of the device 20 has means for coupling the casing 21 to the body of the tap 10. In the example illustrated, the coupling means comprise a bracket 23, which is preferably made of metal or thermoplastic material and is operatively set between the casing 21 and the body of the tap 10. Advantageously, fixing of the bracket 23 can be carried out by exploiting at least one screw that is normally associated to the body of the tap 10, for example a screw used for its fixing to the structure of the appliance 1 or a screw S that, according to the known art is used for fixing the microswitch MS referred to previously (FIGS. 3 and 4). Also fixing of the casing 21 to the bracket 23 can be obtained with screws, or else via mutual coupling and engagement means, such as engagement reliefs or teeth that fit in respective seats.

In variant embodiments (not represented), the bracket 23 may be associated to or integrated with the casing 21, for example by overmoulding plastic material of a part of the casing 21 on the bracket 23, or shaping a part of the body of the casing 21 like a bracket, in order to perform directly functions of coupling to the body of the tap. In other possible embodiments (not represented), the casing 21 of the device may be fixed to the structure of the appliance 1, via a purposely provided bracket or else directly.

Figure 8:
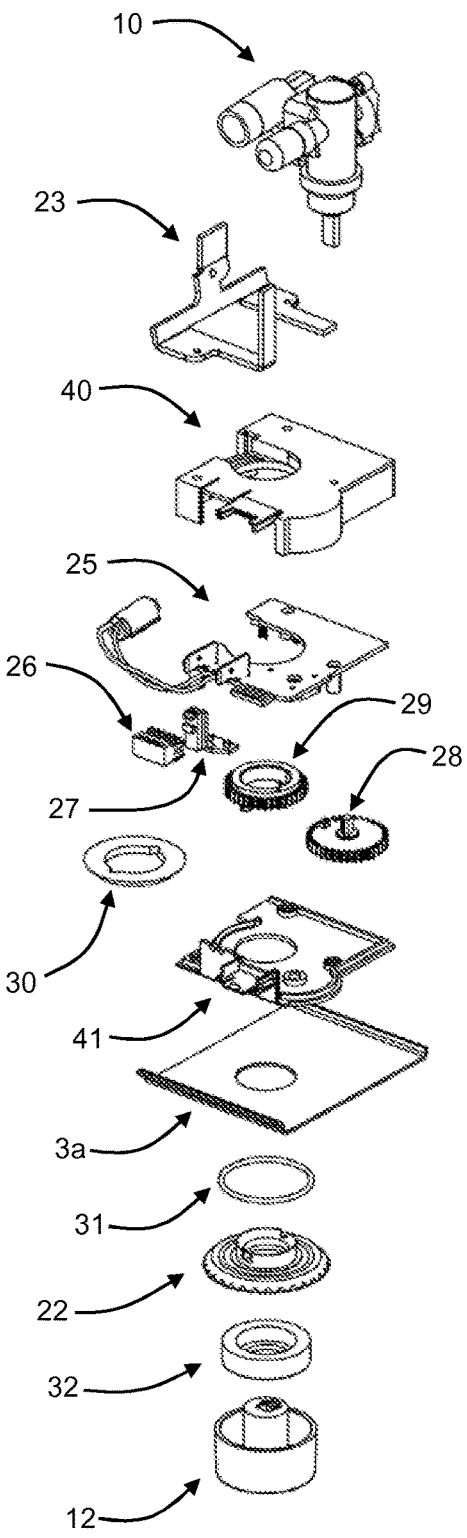
FIGS. 8 and 9 are exploded views, from different angles, of the device of FIGS. 6-7, with some parts of the appliance.
Figure 9:
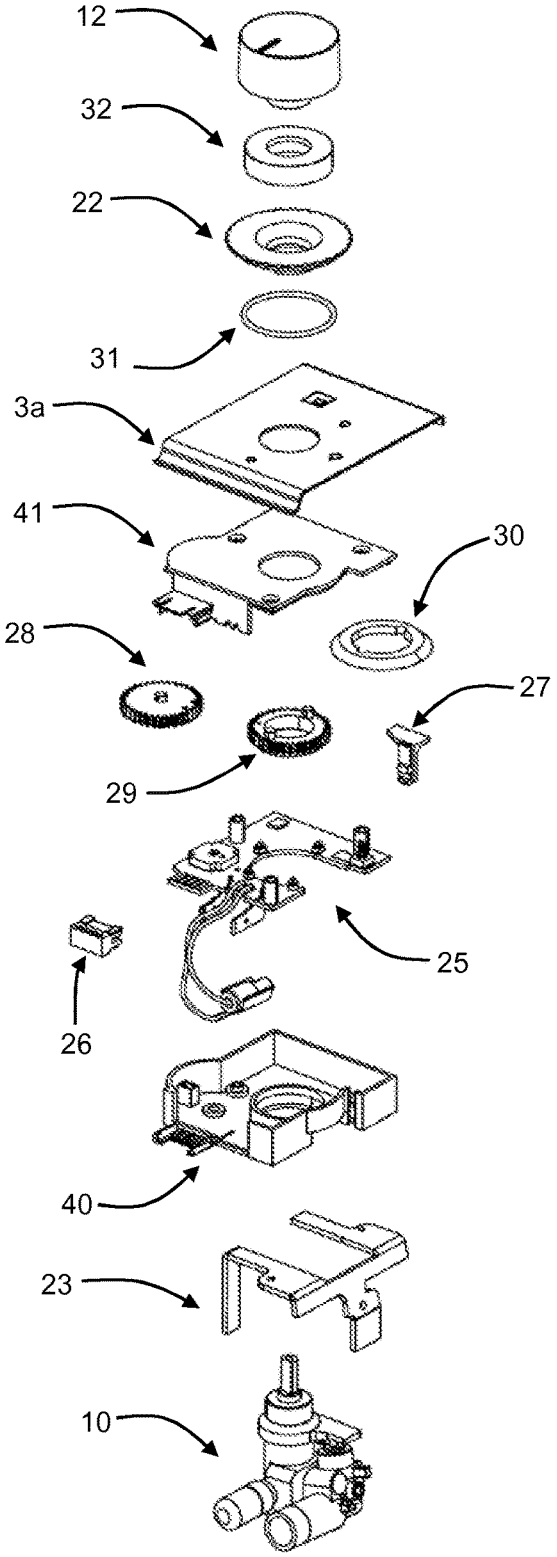

FIGS. 8 and 9 show, from different angles, the components of the timer device according to one embodiment of the invention, as well as some components of the appliance 1 already referred to previously. Visible in these figures are the tap 10, the mounting bracket 23, a first part 40 of the casing 21, a circuit arrangement 25 that equips the device, a connector 26 belonging to an external wiring system (not represented), a control or motion-transmission element 27 for a switching means of the circuit arrangement 25, a transmission member 28 co-operating with the movable part of a sensor of the arrangement 25, a further transmission member 29 which can be actuated by the ring nut 22 to turn the member 28 accordingly, a member 30 intermediate between the transmission member 29 and the ring nut 22, a second part 41 of the casing 21, a sealing element 31, which is preferably of an annular type, designed to operate between the ring nut 22 and the front surface of the wall 3, and an intermediate annular element 32, which is designed to be operatively set between the knob 12 of the tap 10 and the ring nut 22 and is forced on the latter by a spring—visible only in FIG. 15, designated by 32*a*—set between the inside of the knob 12 and the intermediate annular element 32.

Figure 10:
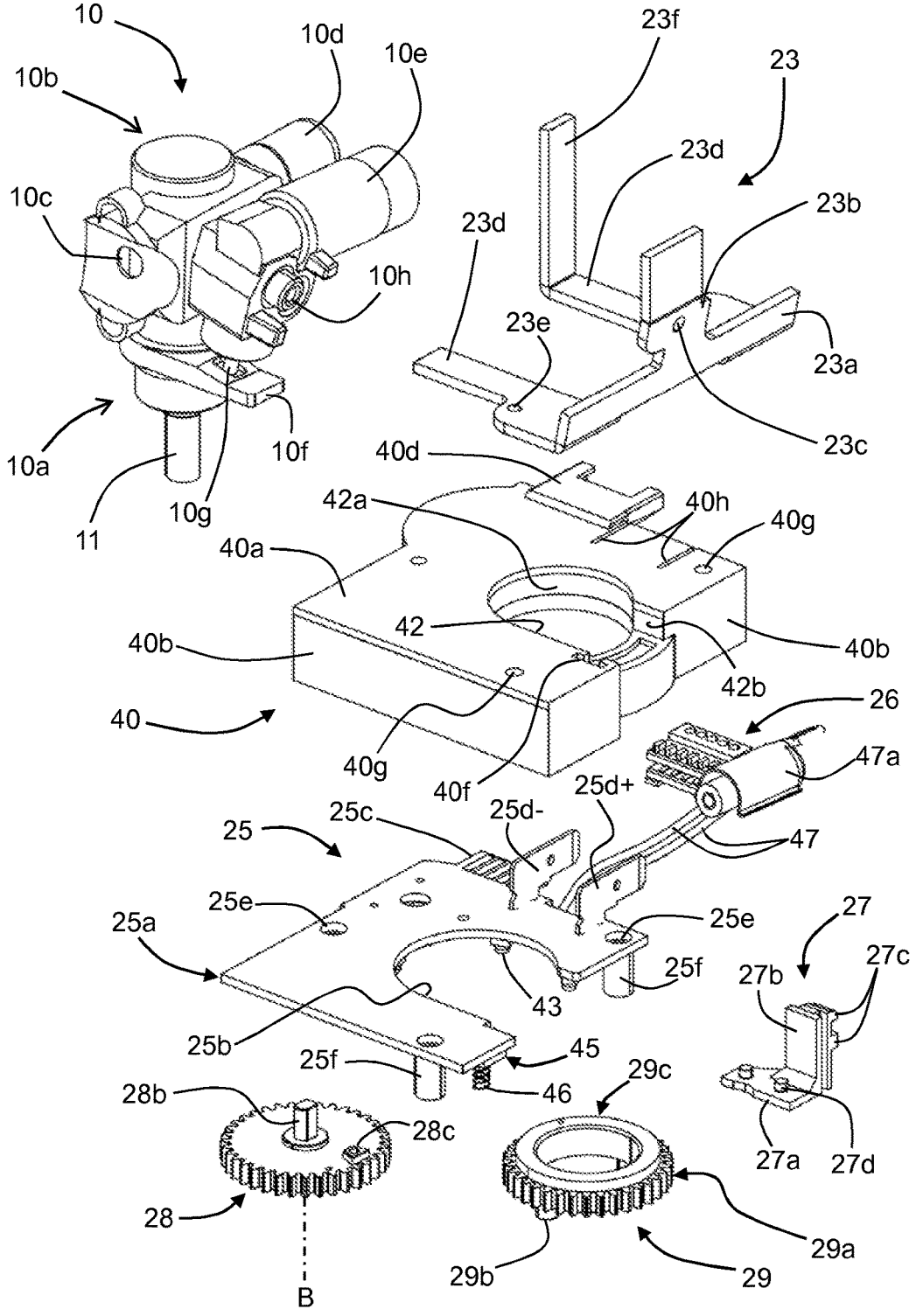
FIGS. 10-13 are exploded views, from different angles, of the device and of the parts of FIGS. 8 and 9.
Figure 11:
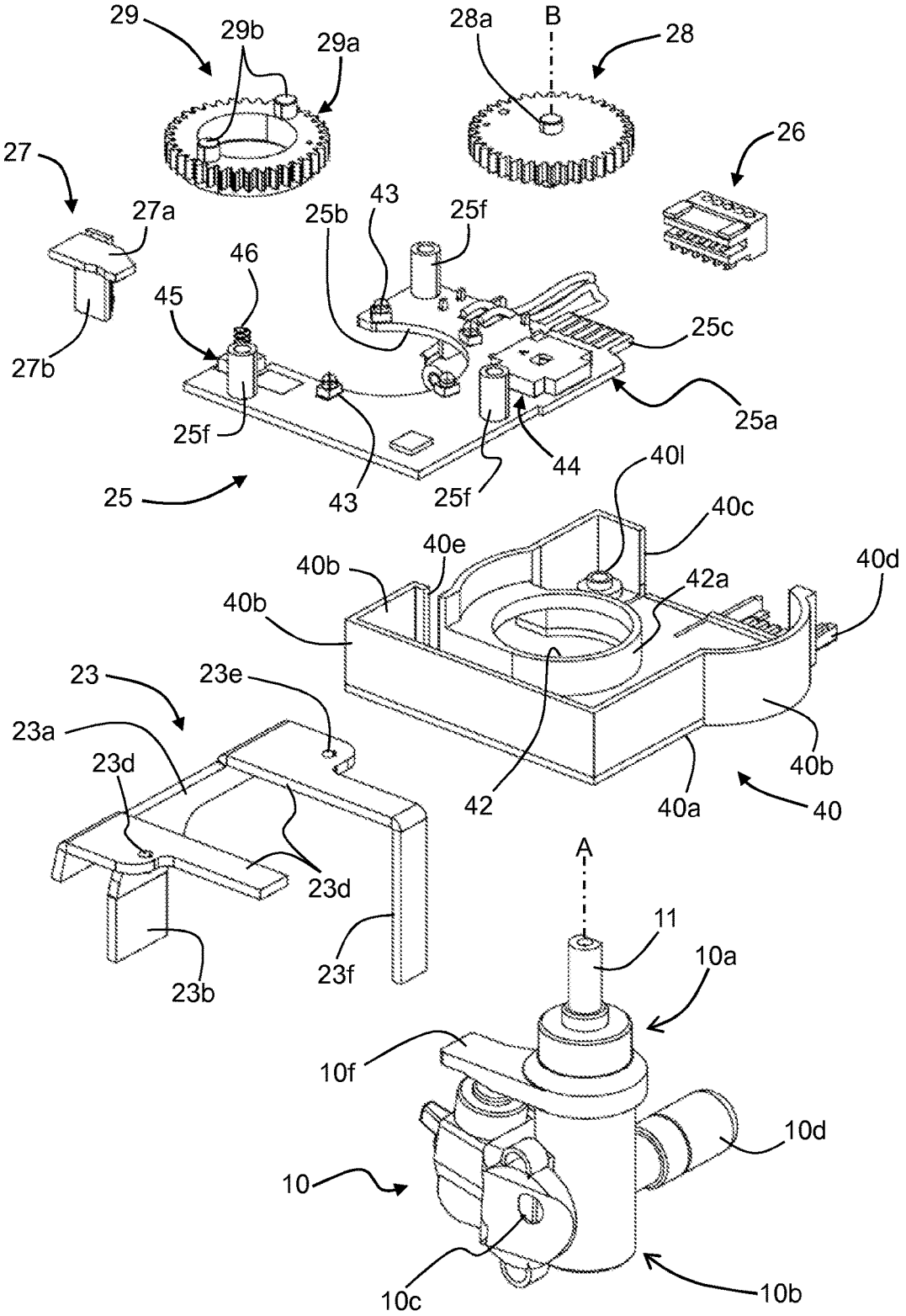

The components of FIGS. 8 and 9 are visible, at a larger scale, in FIGS. 10-13. With particular reference to FIGS. 10 and 11, and as already mentioned, the tap 10 may be of a type in itself known on the market, as described in the introductory part of the present description and with reference to FIGS. 4 and 5.

In traditional applications, as has been said, the actuation element 10*f* may advantageously be exploited also for causing switching in closing of the microswitch MS forming part of the lighter system. As will be seen, in a particularly advantageous embodiment of the invention, the circuit arrangement of the device 20 includes a switching means, which performs also the functions of the aforesaid microswitch MS provided according to the known art. In the case of use of the timer device according to this embodiment, as exemplified here, the traditional microswitch MS may be omitted, and the screw S normally used for its fixing (FIGS. 3 and 4) may be exploited for fixing the bracket 23 to the body of the tap 10.

A possible embodiment of the bracket 23 is visible in FIGS. 10 and 11. In this non-limiting example, the bracket 23 is made of metal and has a longitudinal member 23*a* rising from which is a first upright part 23*b*, provided with a hole 23*c* for the passage of a screw (not represented), for example for engagement in an internal screw 10*h* provided on the body of the tap 10. Said internal screw may advantageously be the one usually provided for the screw S for fixing the microswitch MS provided according to the known art. Branching off from the longitudinal member 23*a* are two cross members 23*d*, generally parallel to one another and substantially orthogonal with respect to the upright 23*a*, provided with respective holes 23*e* for securing the casing 21, for example via screws. At least one of the cross members 23*d* can have an upright terminal part 23*f*, which is preferably substantially orthogonal to the cross member itself, which functions as contrast or resting element with respect to the structure of the appliance 1. It should be noted that the shape illustrated for the bracket 23 is provided merely by way of example, other shapes evidently being possible, which are preferably defined according to the shape of the tap and/or of the casing 21 and/or to the structure of the appliance.

The part 40 of the casing defined hereinafter for simplicity as "container" is substantially box-shaped and made of plastic material, with a bottom wall 40*a* and peripheral walls 40*b* that define a cavity or a seat for housing at least part of the circuit arrangement 25 and of the transmission arrangement including the transmission members 28-30, which are preferably toothed transmission members. Preferably, one of the peripheral walls 40*b* closes only partially the corresponding side of the container 40, thus defining a side opening 40*c* (FIG. 11). At said side opening 40*c*, from the bottom wall 40*a* an appendage 40*d* projects outwards, aimed at providing a first part of a connector body, visible as a whole in FIG. 7, fitted within which is the connector 26.

In a preferred embodiment, one of the peripheral walls 40*b* has an opening or gap 40*e* (FIG. 11), the function of which will be clarified hereinafter, to which there preferably corresponds a slit 40*f* (FIG. 10) defined in the bottom wall 40*a*. In one embodiment, such as the one represented, the bottom wall 40*a* is also provided with holes 40*g* for fixing the casing to the bracket 23, as well as a pair of slits 40*h* (FIG. 10), which are preferably generally parallel and in a position set alongside with respect to the appendage 40*d*.

The casing 21 of the device 20 is configured for coupling with the body of the tap 10, and for this purpose has a passage, in which a corresponding part of the tap may be received passing through it. For example, in the embodiment illustrated, the bottom wall 40*a* has a through opening 42, which is preferably, but not necessarily, substantially circular. Preferably, moreover, the container 40 defines a hollow portion 42*a*, projecting within the corresponding cavity, where the opening 42 is located. Very preferably, moreover, the container 40 also defines an external recess, for housing partially, and with possibility of movement, the actuation element 10*f* of the tap 10.

In the embodiment illustrated, the bottom wall 40*a* and the peripheral wall 40*b* that has the gap 40*e* define together, within the container 40, the aforesaid hollow portion 42*a*, having an outer profile that is at least in part cylindrical. As may be seen in FIG. 10, moreover, a part of the bottom wall 40*a* defines the aforesaid external recess 42*b*, between the opening 42 and a respective wall 40*b*, in particular the one provided with the gap 40*e*.

Figure 12:
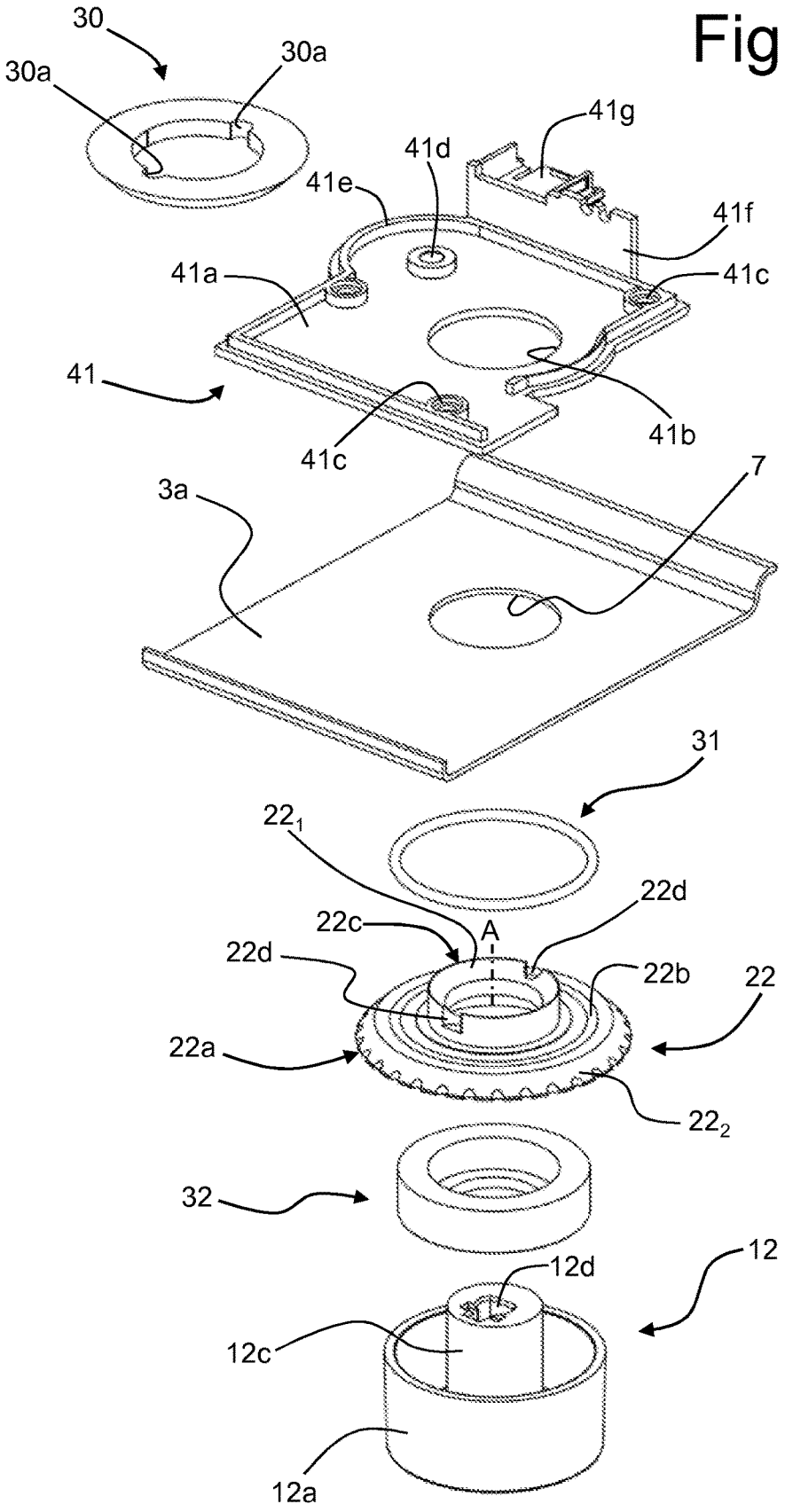
Figure 13:
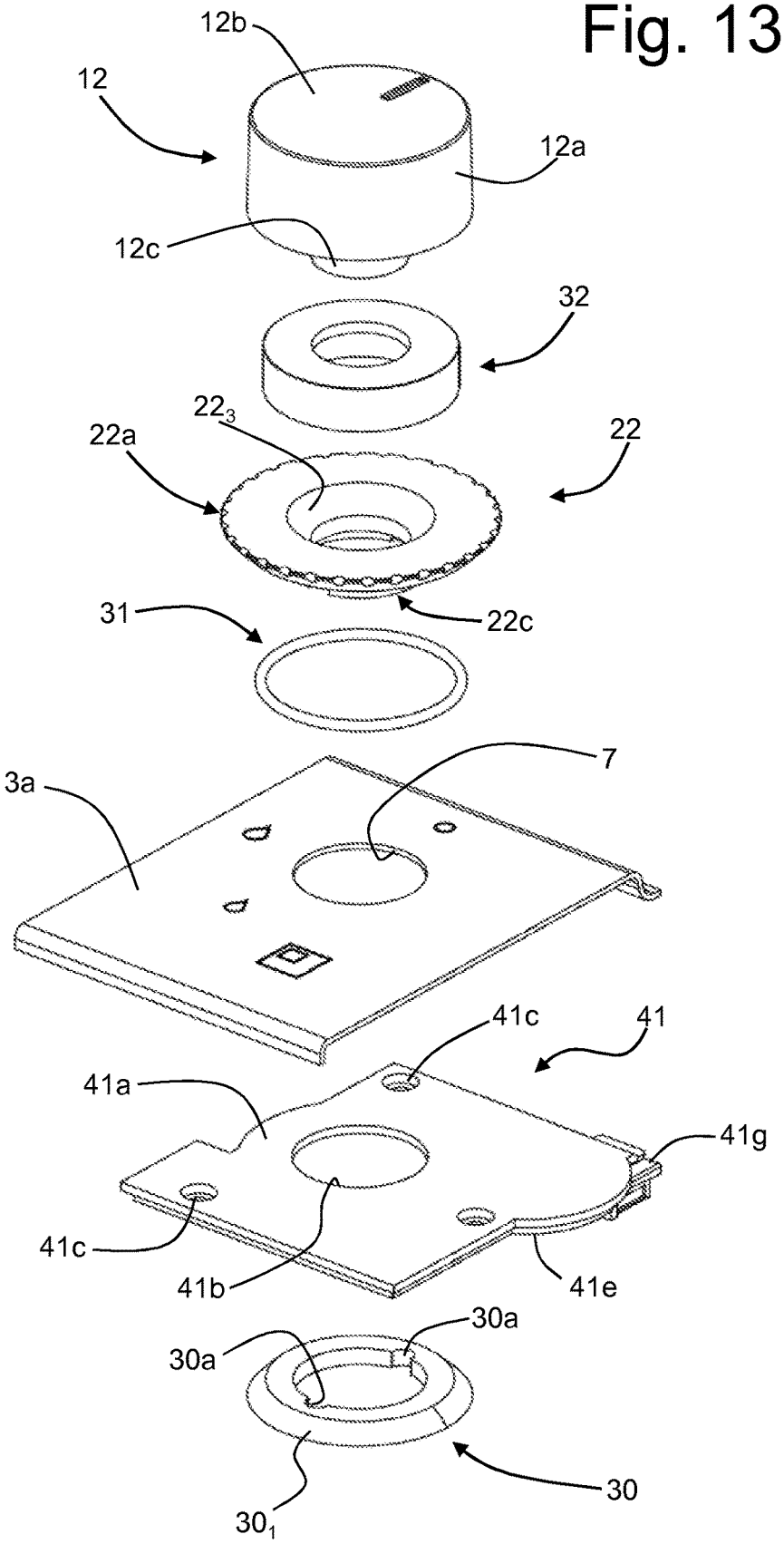

With reference also to FIGS. 12-13, the circuit arrangement 25 preferably includes a printed-circuit board (PCB), designated by 25*a*, which is at least partially housed within the casing 21 and mounted on which are electrical and/or electronic components, connected to tracks (not represented) made of electrically conductive material defined on the circuit board 25*a*. Illustrated in the figures are only the components useful for an understanding of the invention, other electronic components being, however, possibly present, such as active or passive components or microcontroller circuits or memories.

In one embodiment, the circuit board 25*a* has a respective passage that surrounds at least in part the passage of the casing 21. In the example of embodiment, the passage of the circuit board 25*a* is in the form of an opening or slot 25*b* having a profile at least in part similar to or congruent with that of the opening 42 of the bottom wall 40*a* of the container 40 and/or of the corresponding hollow portion 42*a*, and the circuit board 25*a* is mounted in a position generally close to the bottom wall 40*a*. In the example, the slot 25*b* extends as far as an edge of the circuit board 25*a* and has at least a corresponding portion shaped like an arc of circumference. In other embodiments, the passage of the circuit board 25*a* may be circular, such as a hole, for example if the portion 42*a* is generally cylindrical or if it is absent.

The specific embodiment of the control circuit provided on the circuit board 25*a* may comprise—in general terms—the components described in WO 2010/134040, for performing the functions described in said document and/or other specific functions envisaged according to the present invention. An example of circuit will in any case be described hereinafter with reference to FIG. 25. For what is of specific interest herein—and also with reference to FIGS. 10-11—in one embodiment, an end or projecting portion 25*c* of the circuit board 25*a* provides a male electrical connector, the terminals of which are obtained from electrical tracks, in particular of an edge-connector or card-edge type, which, in the condition where the device 20 is assembled, is in a position corresponding to the appendage 40*d* of the container 40, provided for coupling with the external connector 26.

In one embodiment, the circuit arrangement 25 includes light-emitting means, which may comprise one or more emitters, for example of a LED type. Preferably, these emitter means are mounted on a face of the circuit board 25*a*—here defined as upper face—in the proximity of the passage of the casing 21. In the example represented, a number of emitters 43 are provided, arranged at intervals apart around the slot 25*b*. Given that, in the example, the slot

25*b* extends as far as an edge of the circuit board 25*a*, the emitters 43 are arranged according to the profile of the arc-shaped part of the slot itself, preferably at substantially regular intervals.

The circuit arrangement 25 comprises detection or sensor means, for detecting the angular position of the ring nut 22 and supplying accordingly a signal representing a time interval of supply of the burner controlled by the tap 10. In the example, these sensor means include a stationary component 44, preferably mounted on the upper face of the circuit board 25*a*. In one embodiment, the sensor means are of a resistive type, such as a rotary potentiometer or trimmer, actuated by a corresponding part that may be set in rotation following upon a rotation of the ring nut.

In one embodiment, the signal for activation of the timing function of the device 20 is supplied to the circuit arrangement 25 by a control element. Preferably, this control element comprises a switching means, such as a pushbutton switch, preferably a low-power switch, in particular, for voltages ranging between 1 V and 24 V, which can be switched following upon axial displacement of the rod 11 of the tap, for example, the switch designated by 45. Advantageously, if the circuit of the device 20 is prearranged also for connection to a system for lighting the burners of the appliance 1, the signal generated by switching of the control element may also be used for governing the lighter system. In the example represented in FIGS. 11 and 12, the control element represented by the pushbutton switch 45 is provided on the upper face of the circuit board 25*a*. Preferably, but not necessarily, the switch 45 is a double-contact switch.

The motion-transmission element 27 is configured for transmitting an axial movement of the control rod 11 of the tap 10 to the switch 45, and for this purpose is mounted movable on the casing 21, in particular in a slidably way. At least one part of the motion-transmission element 27 faces the outside of the casing 21 in order to be able to interact or couple with the actuation element 10*f* of the tap 10. In embodiments not represented, it is also possible to provide a motion-transmission element configured for direct coupling to the rod 11.

Figure 16:
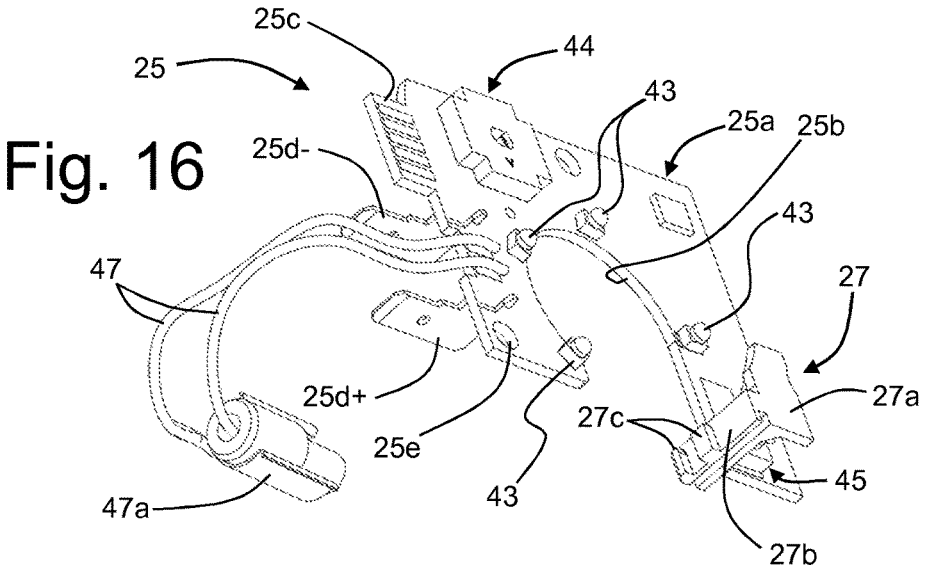
FIGS. 16 and 17 are perspective views, from different angles, of a circuit arrangement of the device of FIGS. 8 and 9.

In the embodiment exemplified, the element 27 has a base part 27*a* and an upright part 27*b*, the latter being shaped for engaging slidably in a vertical direction in the gap 40*e* (FIG. 11) and in the slit 40*f* (FIG. 10). In effect, and as may be appreciated, for example, in FIG. 7, the element 27 is coupled to the container 40 so that its base part 27*a* overlies the pushbutton of the switch 45 in order to be able to cause switching thereof, in particular, via further interposed elastic means (see, for reference, FIG. 20). The upright part 27*b* of the element 27 facing the outside of the casing 21 has a seat for engagement of the element 10*f* of the tap, said seat being here defined by two projections 27*c* (FIGS. 10 and 16) received between which is a part of the element 10*f*. In this way, the axial movement of the rod of the tap, due to pressure applied on the knob 12, brings about a corresponding vertical movement of the element 27 (downwards, as viewed in FIG. 7).

Figure 17:
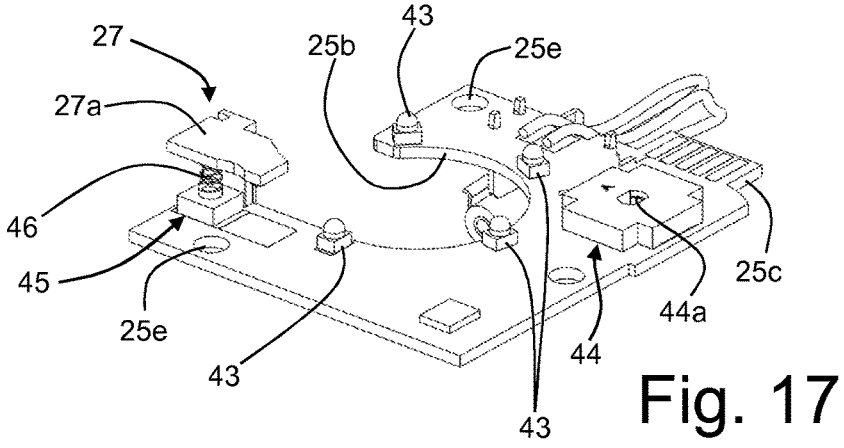

In a preferred embodiment, between the control element represented by the switch 45 and the corresponding actuation element 27, the aforesaid elastic means, or damping means, are provided, in particular having the function of operating the pushbutton of the switch 45 and compensating for possible tolerances of production and assembly and/or preventing risks of excessive stresses exerted by the element 27 on the switch 45. In the embodiment exemplified, and as may be appreciated, for example, in FIG. 17, said means comprise an elastic element 46, in particular a helical spring, operatively set between the element 27 and the pushbutton of the switch 45. In the example, one end of the spring 46 is fitted on a pin 27*d* (FIG. 10) projecting from the lower face of the head part 27*a* of the element 27, and the opposite end is engaged on the pushbutton of the switch 45. The spring 46 is calibrated so that, beyond a certain degree of compression thereof, it will transfer to the pushbutton of the switch 45 the force necessary for switching, said spring 46 being also able to absorb or compensate for possible excessive stresses.

In embodiments not represented, the damping function can be integrated directly in the motion-transmission element, for example by providing in its body an elastically deformable part, having spring functions.

The circuit arrangement 25 of the device includes first connection means for electrical connection to the electromagnet of the safety valve of the tap 10. Once again with reference to the example of FIGS. 10-11 and 16-17, connected to the circuit board 25*a* are electrical conductors or wires 47, represented schematically, for connection of the circuit of the device 20 to the electrical attachment or connector 10*e* of the tap 10, i.e., the attachment where the thermocouple is traditionally connected. Connected to the conductors or wires 47 of the arrangement 25 is a corresponding connector 47*a*, of a type complementary to the attachment 10*e* of the tap 10 and/or to the electrical connector of the electromagnet of the safety valve. Preferably, the connector 47*a* is of a type designed to perform the functions of connection proper to the traditional connectors for thermocouples used on taps of the type considered herein, in particular, a connector 47*a* of an axial type, or of a radial type, or of a Faston type.

In the example represented (see, for example, FIGS. 10, 16 and 18) the connector 47*a* includes two generally coaxial parts, not indicated, and in particular a central part and a peripheral part. The central part, which is at least partially cylindrical, is made of electrically insulating material and defines at the centre an axial seat (FIG. 10), housed within which is a corresponding contact, connected to one of the conductors 47. The peripheral part, connected to the other conductor 47, is in the form of a shaped metal lamina, fitted on the central part and with a corresponding generally arched contact portion that surrounds at least partially the insulating central part, at a distance therefrom. The central part of the connector 47*a* can be inserted in the attachment 10*e* for the thermocouple (see FIG. 7) so that in the corresponding axial seat there fits a terminal with central pin of the attachment 10*e* (see, for example, FIG. 5), which thus electrically couples to the internal contact of the seat itself. The arched portion of the peripheral part of the connector 47*a*, by exploiting a certain elasticity thereof, bears, instead, upon an external cylindrical part of the attachment 10*e*.

In variants not represented, the conductors 47 may be absent, with the connector 47*a* connected or associated directly to the support of the circuit arrangement 25, with said connector, support, and casing of the device 20 appropriately shaped for enabling a connection to the connector 10*e* of the tap 10.

More in general, the electrical connectors, such as a first connector towards the electromagnet of the safety valve of the tap and a second connector towards the thermocouple, may be of the same type or else of different types: in the latter case, the timer device can function also as "adapter" between different connectors, i.e., between a thermocouple having a first type of connector and an electromagnet or safety valve of a gas tap having a second type of electrical connector, or else a timer 20 having a first connector 25*d* different from a second type of connector 47*a*.

The arrangement 25 likewise includes second connection means for electrical connection to the thermo-electric generator of the tap 10, i.e., the corresponding thermocouple. In the device 20 represented the conductors of the thermocouple—not represented—that equips the tap 10 are connected to the circuit arrangement 25*a* via fast-coupling connectors, which are preferably blade connectors, such as Faston connectors. In the example represented, projecting from the lower face of the circuit board 25*a* are two blade contacts 25*d*+ and 25*d*− (hereinafter, where not strictly necessary, designated simply by 25*d*), in particular of a male Faston type, which are generally L-shaped and are parallel to one another. The contacts 25*d* pass through the slits 40*h* of the bottom 40*a* of the container 40 so that their contact part projects outwards, as may be seen, for example, in FIG. 22, providing an electrical connector of the device 20 for the thermocouple. On the aforesaid projecting part of the contacts 25*d* there may be fitted the connectors of the thermocouple, which in this case are of a female Faston type.

It will be appreciated that, in the example represented, the connection means proper to the thermocouple (here female Faston connectors) are of a different type from the connection means of the thermocouple provided by the tap (here the attachment 10*e* of a coaxial type): the device 20 consequently functions as "adapter", as explained above.

Note that the contacts 25*d* could be replaced by a cable with two conductors provided with a connector for a thermocouple.

The circuit board 25*a* preferably has positioning and fixing through holes 25*e*, designed to couple with reliefs 401 (FIG. 11) of the bottom wall 40*a* of the container 40, said reliefs being axially hollow for receiving the screws that pass also into the holes 40*g* of the bottom 40*a* (FIG. 10). At the holes 25*e* bushings 25*f* are preferably mounted, on the upper face of the circuit board 25*a*, basically having the function of spacers and/or positioning elements with respect to the casing part 41, defined hereinafter as "lid". The bushings 25*f* may possibly form part of the lid 41.

In a preferred embodiment of the timer device 20, the movable part of the position-sensor means—actuated by, or including, the shaft designated by 28*b*—is able to rotate about an axis that is different from the axis about which the ring nut 22 turns, in particular is substantially parallel thereto, and operatively set between the ring nut 22 and the movable part of the sensor means is a transmission arrangement; i.e., the device 20 comprises a transmission arrangement, set between the control element or ring nut 22 and the position-sensor means.

In the preferred embodiment, the aforesaid transmission arrangement includes a first transmission member that is substantially coaxial to the ring nut 22 and is able to turn therewith. This first transmission member has an axial cavity, in which there may be received a corresponding part of the tap 10, and the ring nut 22 is coupled in a separable way to this transmission member.

Preferably, the transmission arrangement includes at least one second transmission member, which is engaged in rotation with the first rotating member and is able to set in rotation the movable part of the position-sensor means.

In the example represented, the transmission arrangement comprises the rotating members previously designated by 29 and with 28, which represent the aforesaid first and second transmission members, respectively.

Once again in FIGS. 10 and 11 there may be noted a possible embodiment of the rotating member 28, directly integrated in which is an actuation element for actuating the movable part of the sensor means. For this purpose, the member 28 co-operates with the stationary component 44 of the position-sensor means, such as a variable resistor, hereinafter defined for simplicity as "potentiometer".

In a preferred embodiment, the member 28 basically comprises a gear, the axis of rotation B of which is defined by a pin 28*a* projecting from its upper face, said pin being designed for engagement in a respective cylindrical rotation seat 41*d* of the lid 41 (FIG. 12).

Projecting, instead, from the lower face of the member 28 is a shaft 28*b*, coaxial to the upper pin 28*a*, which provides an element for actuation of the movable part of the position-sensor means. The shaft 28*b* preferably has a cross section that is at least in part square (not circular), designed to couple mechanically to an internal movable member of the potentiometer 44, partially visible in FIG. 17, where it is designated by 44*a*: in practice, then, the shaft 28*b* of the member 28 provides the element for actuation of the movable part 44*a* of the potentiometer or trimmer 44.

In a preferred embodiment, mechanical end-of-travel means are provided for rotation of the member 28, which preferably comprise an element carried by the member itself, designed to interact with a stationary contrast element. For this purpose, in the case represented, projecting from the lower face of the member 28 is an arrest element 28*c*, designed to interfere with a fixed contrast element of the container 40. A contrast element of this sort is designated by 40*i* in FIG. 18. The arrest element 28*c* and the contrast element 40*i* may be shaped, for example, in such a way that the useful travel of the ring nut 22 is approximately 320°. In one embodiment, the element 28*c* and the contrast element 40*i* are shaped so as to provide a point of respective mild engagement, for example so as to define an initial position of inactivity of the device 20 (for example, the element 28*c* may be shaped so that it can snap into the hollow seat of the element 40*i*). The angular area corresponding to a complete rotation—for example in a clockwise direction—in the proximity of the contrast element 40*i* (for example, with the element 28*c* engaged in a releasable way in the cavity of the contrast element 40*i*) defines an area or position of mechanical zero. This angular area, which may be approximately 12° wide, has a particular meaning for operation of the device 20, in so far as, together with the ring nut 22 positioned in the aforesaid area, it is generally in a state of inactivity. In this example, then, the duration of the interval of supply of the burner increases with rotation of the ring nut 22 in a counterclockwise direction.

According to variants not represented, means for providing a snap coupling or engagement that defines an angular position or angular area of mechanical zero may be associated to other elements of the device, such as the ring nut 22 and/or the member 29.

The second rotating member 29 constitutes an axially hollow transmission element, which can be coupled in a separable way to the ring nut 22 and is coaxial thereto in order to turn according to the axis denoted by A in various figures, also corresponding to the axis of rotation of the stem 11 of the tap 10.

For this purpose, in the example illustrated, the member 29 comprises a circular ring gear 29*a*, projecting from the upper face of which are engagement elements 29*b*. Preferably, at least two engagement elements 29*b* are provided in diametrally opposite positions. Very preferably, the engagement elements 29*b* have a substantially cylindrical shape.

Advantageously, the transmission member 29 is rotatably supported by a corresponding portion of the casing 21, at the corresponding passage. For this purpose, in the example represented, projecting from the lower face of the circular ring gear 29*a* is a cylindrical annular part 29*c*, having a smaller circumference than the one defined by the teeth of the ring gear 29*a*. The cylindrical part 29*c* is designed to insert with minimal play or with slight interference in the through opening 42 of the bottom wall 40*a* of the container 40 so that it can turn therein about the axis A, sustained on the hollow portion 42*a*. In the assembled condition of the device 20, and as may be noted, for example, in FIG. 19, the toothings of the two members 28 and 29 mesh together so that rotation of the member 29 causes rotation of the member 28, and hence of the shaft 28*b*, coupled to the angular sensor represented by the potentiometer 44.

Coming now to FIGS. 12-13, in a preferred embodiment, the transmission arrangement also includes the intermediate member 30, prevalently located within the casing of the device 20. The intermediate member 30 has a respective axial cavity and is operatively set between the ring nut 22 and the transmission member 29 so as to turn therewith according to the axis A. The ring nut 22, prevalently located on the outside of the appliance 1, is preferably made of transparent material, for example a transparent thermoplastic material, such as polycarbonate or methacrylate, for performing functions of light guide or optical guide, in order to receive and/or transfer light radiation, in particular, from the inside to the outside of the appliance 1.

The through cavity of the member 30 preferably has a diameter greater than that of the member 29. Preferably, the intermediate member 30 has a generally annular shape, with an end face facing the upper face of the toothed member 29, in order to be able to rest at least partially thereon.

According to an advantageous characteristic, an optical guide is provided here made up of a number of parts, such as the elements 22 and 30 preferably made of transparent thermoplastic material, for transferring a light signal from the inside of the device 20 and/or of the appliance 1 to the outside of the appliance 1.

In one embodiment, the member 30 performs functions of light guide or optical guide, for transfer of light radiation generated by the emitter means 43 to the ring nut 22. In this embodiment, the member 30 and at least part of the ring nut 22 are made of a transparent material, for example methacrylate, or in any case a material that is able to transmit the light generated by the emitters 43.

Figure 20:
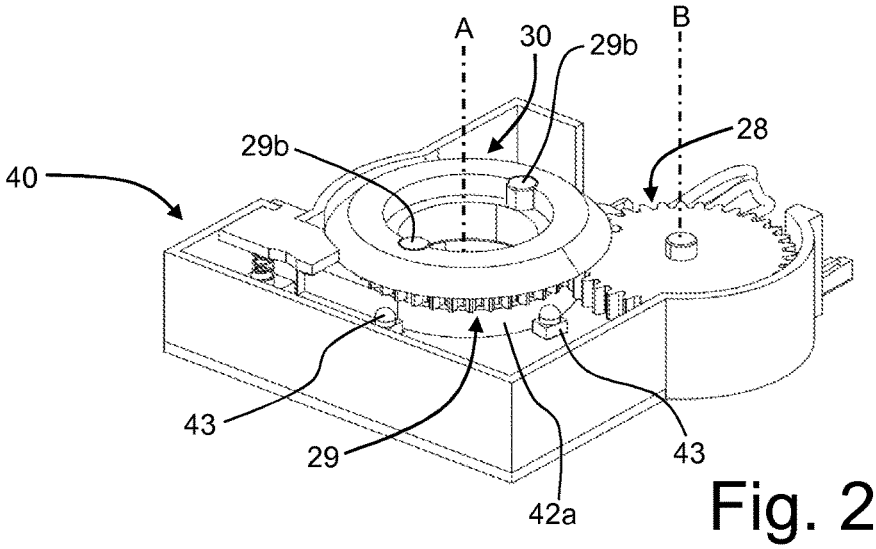

For this purpose, in a preferred embodiment, the diameter at the base of the member 30 is greater than the diameter defined by the teeth of the member 29 so that a peripheral annular region of the upper face of the member 30 faces directly the emitters 43, as may be noted, for example, from FIG. 20. Preferably, the intermediate member 30 has a frustoconical outer profile, in particular with an inclination of its peripheral wall $\mathbf{30}_1$ (FIG. 14) substantially equal to 45° with respect to the base. In this way, the light radiation generated by the emitters 43 impinges on the annular region of the lower face of the member 30 that projects beyond the member 29. The light radiation is reflected within the body of the member 30 by the peripheral wall $\mathbf{30}_1$, in a substantially orthogonal or radial direction, i.e., towards the surface of the axial cavity of the member 30. As will be seen hereinafter, in the axial cavity of the member 30 there is received, preferably in a separable way, a corresponding portion of the ring nut 22, which can then transfer the light frontally, beyond the wall 3*a* of the appliance.

The internal surface of the member 30 defines seats 30*a*, in the form of axial recesses, of a shape complementary to at least part of the outer profile of the engagement elements 29*b* of the member 29 in order to enable mutual coupling thereof that enables transmission of a rotation of the member 29 to the member 30, as may be seen, for example, in FIG. 20. In the example of embodiment illustrated, then, at least two seats 30*a* are provided, in diametrally opposite positions, preferably having a substantially semi-cylindrical profile.

The lid 41 of the casing, made of plastic material, has a respective bottom wall 41*a*, defined in which is a through opening 41*b*, here circular, which forms part of the aforesaid passage of the casing 21 and inserted in which is part of the tap 10. In the example, the through opening 41*b* has a diameter substantially corresponding to that of the opening 42 of the container 40 and/or substantially corresponding to the diameter of the portion of tap 10 on which it is mounted. The bottom wall 41*a* of the lid 41 also has holes 41*c* for the passage of the screws used for fixing the lid and the container together and/or with respect to the bracket 23, the screws also passing between the spacer bushings 25*f* previously mentioned. On the internal face of the lid 41 the cylindrical seat 41*d* is also defined, for receiving a corresponding portion of the pin 28*a* of the toothed member 28. In embodiments not represented, the lid 41 and the container 40 are associated to one another and/or fixed via means different from the ones illustrated, such as means for mutual engagement of the lid and/or of the container, preferably of a snap-in type, or else fixed by gluing or welding, in particular, welding of a laser or vibration type, or by hot re-melting of a plastic material of at least one of the lid and the container. Coupling or fixing between the lid 41 and the container 40 is preferably of the sealed type, possibly with the aid of sealing elements set in between.

Projecting from the same face of the lid 41, preferably along the corresponding perimeter, are reliefs 41*e*, for centering the lid itself on the container 40, as well as a side wall 41*f*, designed to close the opening 40*c* of the container 40 (FIG. 11). Projecting outwards from the aforesaid wall 41*f* is an appendage 41*g*, set in a position corresponding to that of the appendage 40*d* of the container 40. In the assembled condition of the device 20, the appendages 40*d* and 41*g* define at least part of an electrical-connector body, which houses the portion 25*c* of the circuit arrangement 25 on which the connector 26 is coupled (see, for reference, FIG. 7 or FIG. 24, in which a part of the wiring to which the connector 26 belongs is also visible). The portion 25*c* and/or the corresponding connector body 40*d*, 41*g*, on one side, and the connector 26, on the other side, may advantageously be provided with engagement means and/or polarization or encoding means in order to enable electrical coupling only with a predefined connector 26 and/or in a unique direction. The polarization or encoding means may, for example, comprise seats and/or cavities and/or holes made in the circuit board 25*a* and/or in the connector 25*c* and/or in the connector body 40*d*, 41*g*, designed to couple with respective polarization or encoding means of the connector 26. Likewise, the engagement means may, for example, comprise at least one tooth for engagement on the connector 26 and a corresponding seat for engagement on the circuit board 25*a* and/or the connector 25*c* and/or the corresponding connector body, or vice versa.

In the embodiment illustrated the connector appendages or portions 40*d* and 41*g* define at least one of engagement means and polarization means, for unique coupling with the predefined connector 26. More in particular, the appendage 41*g* includes a tooth (see, for example, FIG. 12) designed to couple in a corresponding seat of the body of the connector 26, whereas the appendage 40*d* has an insertion "key"

comprising reliefs and cavities (partially visible in FIG. 11), for coupling with a respective substantially complementary part of the connector 26.

The connector 26 is preferably provided with elastic electrical terminals or connections, designed to contact the respective electrical terminals of the connector 25*c*, which are preferably made in the form of electrical tracks on the circuit board 25*a*, but could also be constituted by rigid metal terminals. The connection of the connector 26 to the corresponding wiring may, for example, be obtained by insulator-punchthrough connection means.

In the example of embodiment provided, the ring nut 22 has an axial cavity, in which there may be received a corresponding part of the gas tap, preferably comprising at least part of the rod 11. The ring nut 22 has a gripping portion 22*a*, which is preferably provided on the surface with knurling or the like. The outer profile of the gripping portion 22*a* is preferably substantially frustoconical, with major diameter on its face opposite to the wall 3*a* of the appliance, and in particular with an inclination of its peripheral wall $\mathbf{22}_1$ (FIG. 14) substantially of 45°. Preferably, moreover, at the upper end of the axial cavity of the ring nut, the gripping portion 22*a* defines an inclined annular wall $\mathbf{22}_2$, in particular with an inclination substantially of 45° and opposite to that of the external peripheral wall $\mathbf{22}_1$.

On the opposite face of the portion 22*a* a seat 22*b* is defined for the sealing element 31, which is preferably an annular gasket, of an O-ring type. In the condition where the device 20 is installed, the element 31 is designed to co-operate in a sealed way with the front surface of the wall 3*a* of the appliance.

Figure 24:
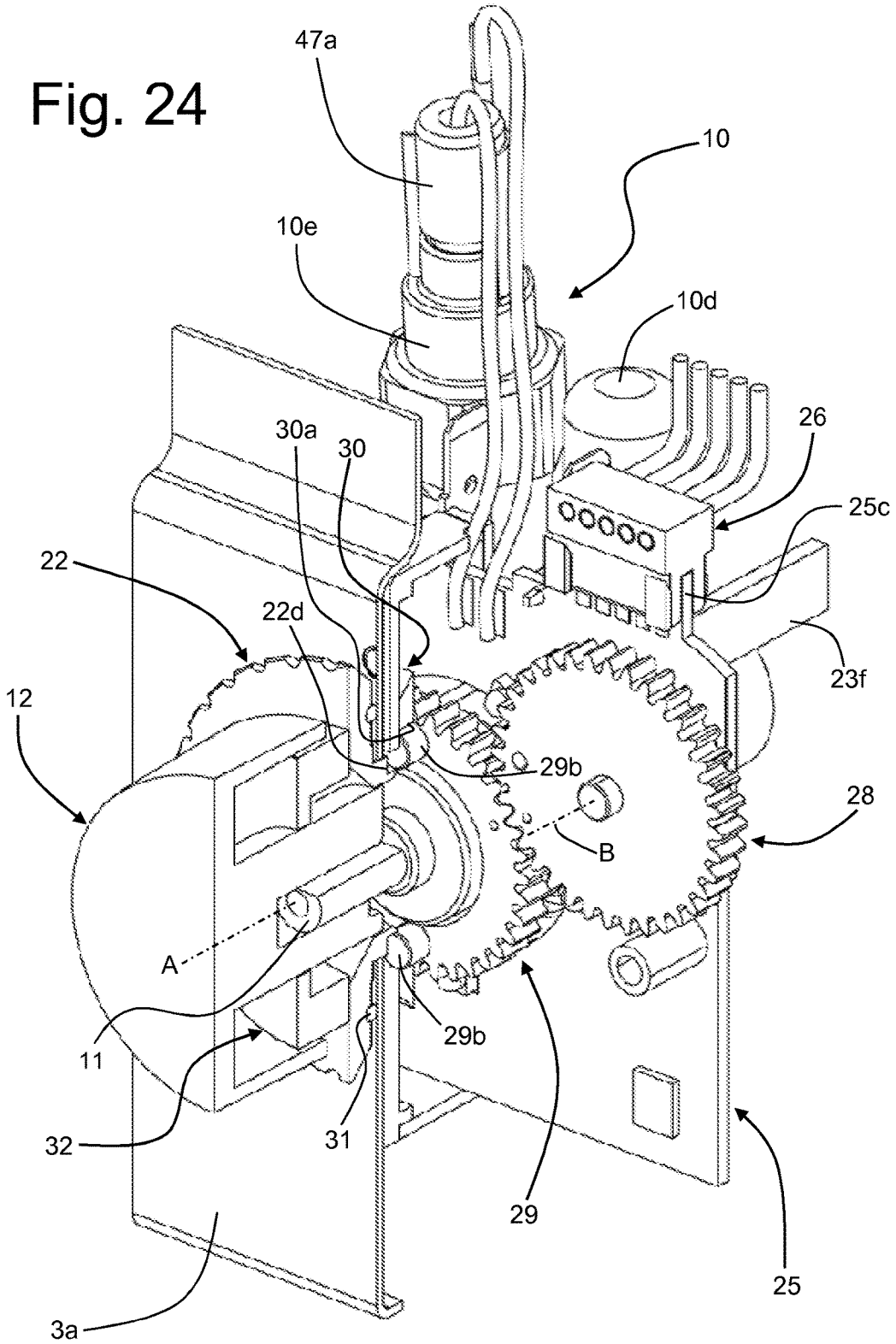
FIG. 24 is a perspective view of the same type as that of FIG. 6, but rotated and partially sectioned.

Rising from the lower face of the gripping portion 22*a* is a cylindrical hollow portion 22*c*, on the outer surface of which seats 22*d* are defined, in the form of axial recesses, having a shape at least in part complementary to the outer profile of the engagement elements 29*b* of the toothed member 29 in order to obtain mutual coupling between them that enables transmission of a rotation of the ring nut 22 to the member 29, as may be seen, for example, in FIG. 24. In the example of embodiment illustrated, then, at least two seats 22*d* are provided, in diametrally opposite positions, preferably having a substantially semi-cylindrical profile. In general, then, the seats 30*a* of the intermediate member 30 and the seats 22*d* of the ring nut 22, in the form of axial recesses, are preferably such as to couple to one another or face each another so as to provide seats of a shape substantially complementary to the outer profile of the respective engagement elements 29*b* of the rotating member 29, in particular, seats having a substantially cylindrical profile.

In a preferred embodiment, the end face $\mathbf{22}_3$ (FIG. 14) of the cylindrical portion 22*c* of the ring nut 22 opposite to the gripping portion 22*a* is inclined inwards; i.e., it has an inclination opposite to that of the peripheral wall $\mathbf{22}_2$ of the portion 22*a*, in particular an inclination substantially equal to 45° with respect to the axis of rotation.

Figure 14:
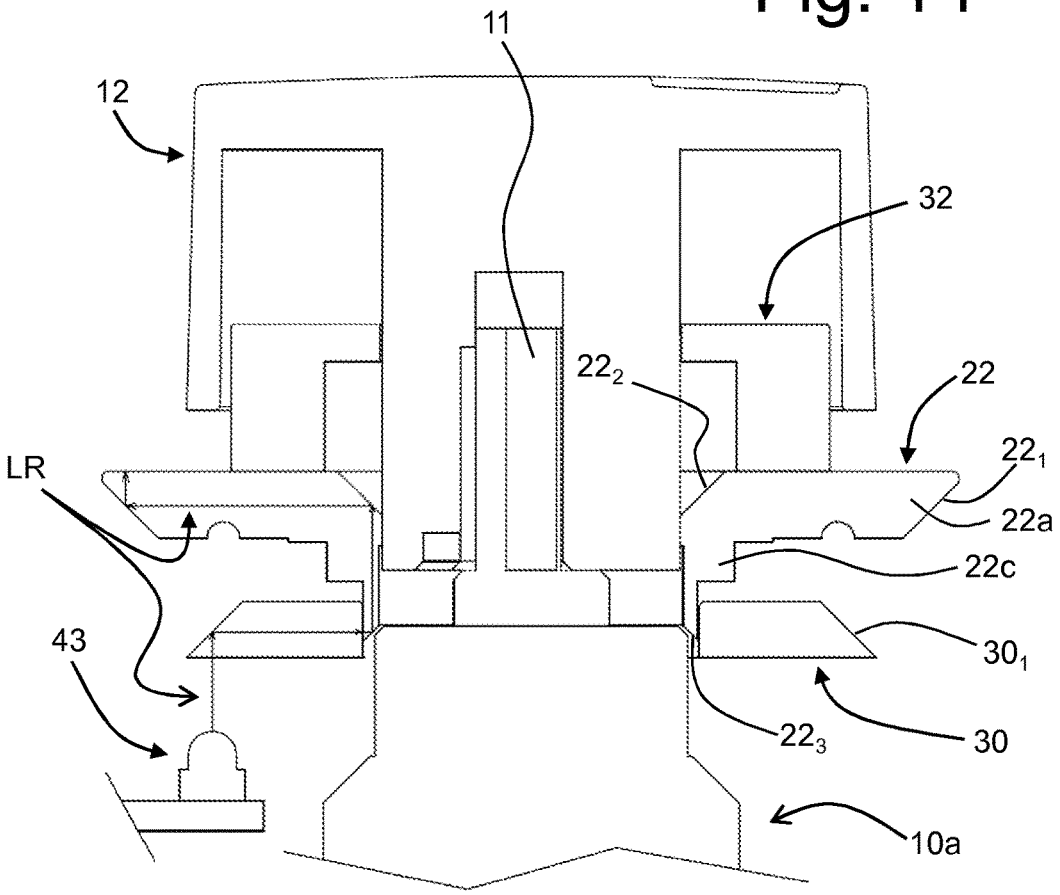
FIG. 14 is a schematic cross section of some components of the device of FIG. 6 assembled together, aimed at illustrating operation of a corresponding light guide.

FIG. 14 exemplifies a mode of transmission of light from an emitter 43 to the ring nut 22. It may be noted that in this figure the representation of some components of the device has been omitted, for greater clarity.

As has already been seen, an outer annular part of the lower face of the member 30 is set facing the emitters 43. The light radiation LR emitted by an emitter 43 impinges on the bottom face of the member 30 and then proceeds inside it in an axial direction, until it encounters the corresponding inclined peripheral wall $\mathbf{30}_1$. The wall $\mathbf{30}_1$ hence reflects at least part of the light radiation in a substantially radial direction (i.e., a direction substantially orthogonal to that of the radiation entering the body of the member 30), in the direction of the centre of the member 30.

Possibly, one or more surfaces of the components involved may be treated for improving transfer of light radiation. The various walls of the optical guide could even present angles and/or conformations different from the ones exemplified, provided that the function described is guaranteed.

The radiation propagates in the cylindrical portion 22*c* of the ring nut 22, fitted in the cavity of the member 30. The radiation proceeds in the body of the portion 22*c* in a radial direction, in the direction of the axis of rotation, until it encounters the inclined end face $\mathbf{22}_3$ of the cylindrical portion 22*c*. This face $\mathbf{22}_3$ now reflects at least part of the radiation within the cylindrical portion 22*c*, in an axial direction, until it encounters the inclined wall $\mathbf{22}_2$ defined at the top end of the axial cavity of the ring nut. The wall $\mathbf{22}_2$ then reflects at least part of the radiation again in a radial direction, now outwards, over the gripping portion 22*a* of the ring nut, towards its part that projects radially from the knob 12 of the tap. The radiation proceeds in the body of the gripping portion 22*a* until it encounters the corresponding peripheral wall $\mathbf{22}_1$, which reflects again the radiation in an axial direction, so that it is evident for the user.

Preferably, the outer diameter of the cylindrical portion 22*c* is smaller than the diameter of the opening 7 provided on the wall 3*a* of the appliance and only slightly smaller than the diameter of the opening 41*b* of the lid, in such a way that the ring nut 22 can be turned manually. The outer diameter of the cylindrical portion 22*c* is also slightly smaller than the diameter of the axial cavity of the member 30 so that it can be inserted therein, with the corresponding seats 22*d* that fit on the part of the engagement elements 29*b* opposite to the part that is engaged in the seats 30*a* of the member 30, as may be appreciated, for example, from FIG. 24. Consequently, the arrangement is such that a rotation imparted manually on the ring nut 22 is transmitted both to the toothed member 29 and to the intermediate member 30, given the coupling of the elements 29*b* of the member 29 with the seats 30*a* and 22*d* of the member 30 and of the ring nut 22, respectively. Rotation of the member 29 then brings about rotation of the member 28, with the shaft 28*b*, and thus variation of the adjustment value of the potentiometer 44.

The intermediate element 32 also has a generally annular shape and is provided for being operatively mounted between the ring nut 22 and the knob 12, preferably at least partially in a concealed position, as may be seen for example in FIG. 24. It may be noted that intermediate elements similar to the element 32 are normally provided in knobs for gas taps, on the aforesaid known intermediate elements there being mounted an annular gasket, designed to operate in a sealed way on the outer surface of the appliance.

Figure 15:
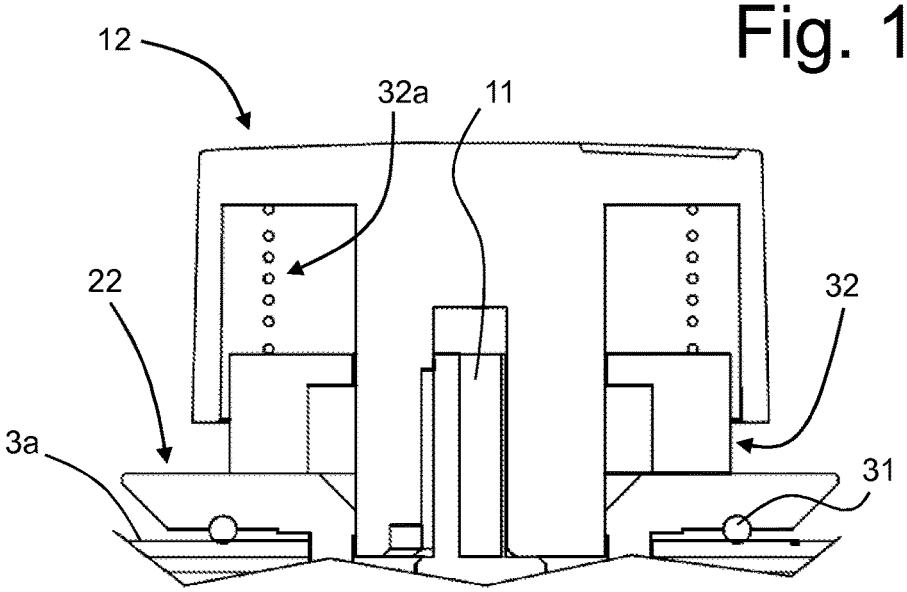
FIG. 15 is a schematic cross section of some components of the device of FIG. 6 assembled together, amongst which an elastic element provided for urging an ring nut of the device itself.

In a preferred embodiment, and as may be noted in FIG. 15, the element 32 is pushed by a spring 32*a*—mounted inside the knob 12, in order to press the ring nut 22 towards the surface 3*a* of the appliance: in this way, the sealing element 31 of the ring nut 22 is pushed against the surface 3*a*. Possibly, also the element 32 may be provided with an annular gasket on its bottom face, for improving the seal between the element 32 itself and the ring nut 22.

In the example represented, the knob 12 of the tap 10 has a main part that includes a cylindrical wall 12*a* and a top closing wall 12*b*, extending from a bottom face of which is a cylindrical shank 12*c*, substantially coaxial to the wall 12*a*. Defined in the shank 12*c* is an axial seat 12*d* for receiving and engaging the rod 11 of the tap 10, with a coupling such that a rotation imparted on the knob 12 will cause rotation of the rod 11. The diameter of the axial passage of the intermediate element 32 is slightly greater than that of the shank 12*c*, whereas the outer diameter of the element 32 is only slightly smaller than the inner diameter of the cylindrical wall 12*a* of the knob. In this way, the knob 12 can also be pressed to enable axial sliding of the rod 11 of the tap 10, with the knob itself that can slide on the element 32, the latter resting on the ring nut 22.

It goes without saying that the inner diameter of the axial passage of the ring nut 22 is only slightly greater than that of the shank 12*c* of the knob 12 and that the inner diameters of the axial passages of the members 29 and 30 are such as to enable insertion through them of the head portion 10*a* (FIGS. 10-11) of the tap 10, which also passes through the openings 42 and 40*b* of the container 40 and of the lid 41 of the casing 21.

Figure 18:
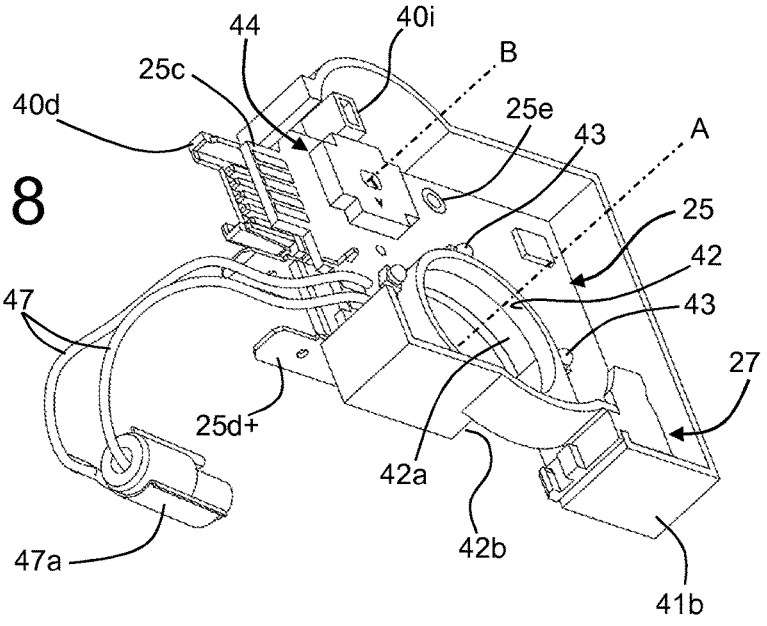
FIGS. 18, 19 and 20 are partial perspective views of the device of FIGS. 8-9, in different steps of assembly.
Figure 19:
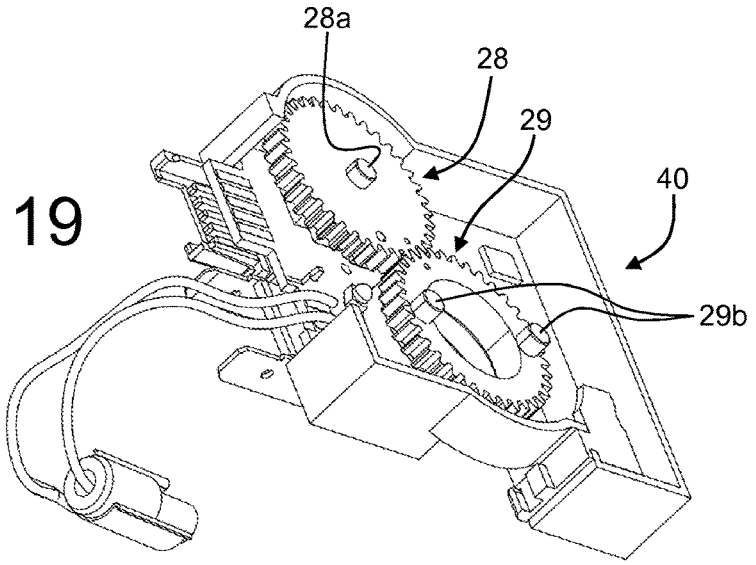
Figure 21:
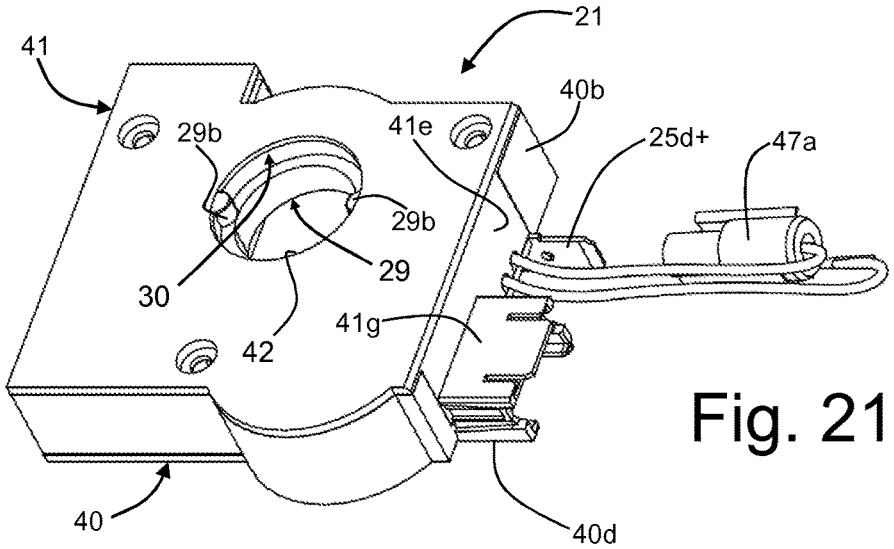
FIGS. 21 and 22 are partial perspective views of the device of FIGS. 8-9.
Figure 22:
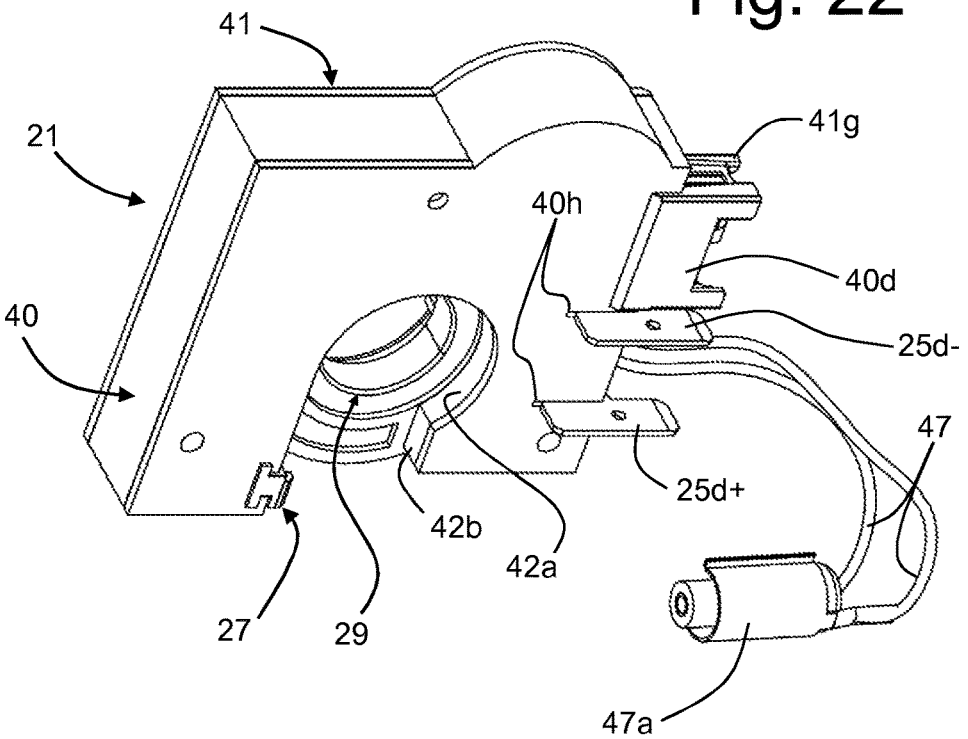

FIG. 18 represents a condition of partial assembly of the timer device, visible in which is the container 40 within which the circuit arrangement 25 including the circuit board 25*a* is located. In FIG. 19 the toothed transmission members 28 and 29 are also assembled, whilst FIG. 20 also includes the intermediate member 30. FIGS. 21 and 22 represent, instead, in different views, the casing 21 assembled, with the circuit arrangement and the transmission arrangement previously described inside it. From these figures there may be appreciated the compact configuration of relatively small thickness of the casing 21, and it may be noted how the axial cavity of the transmission member 29 defines at least one respective portion of the passage for the front part of the tap. It may likewise be appreciated that the transmission arrangement described, thanks to the axial cavities of the members 29 and 30, enables adequate shielding of the inside of the casing 21, also in the case where the ring nut 22 is removed. It will be appreciated that the movement of the ring nut 22 is transferred to the corresponding sensor means 44 via the transmission arrangement 28-30. In this way, any direct stress on the sensor means and/or on the circuit board 25*a* is prevented. It will likewise be appreciated that, in the embodiment illustrated, the part of the transmission system to which the ring nut 22—i.e., the member 29—is associated does not touch the circuit board 25*a*, but is supported by a portion (42*a*) of the casing.

Figure 23:
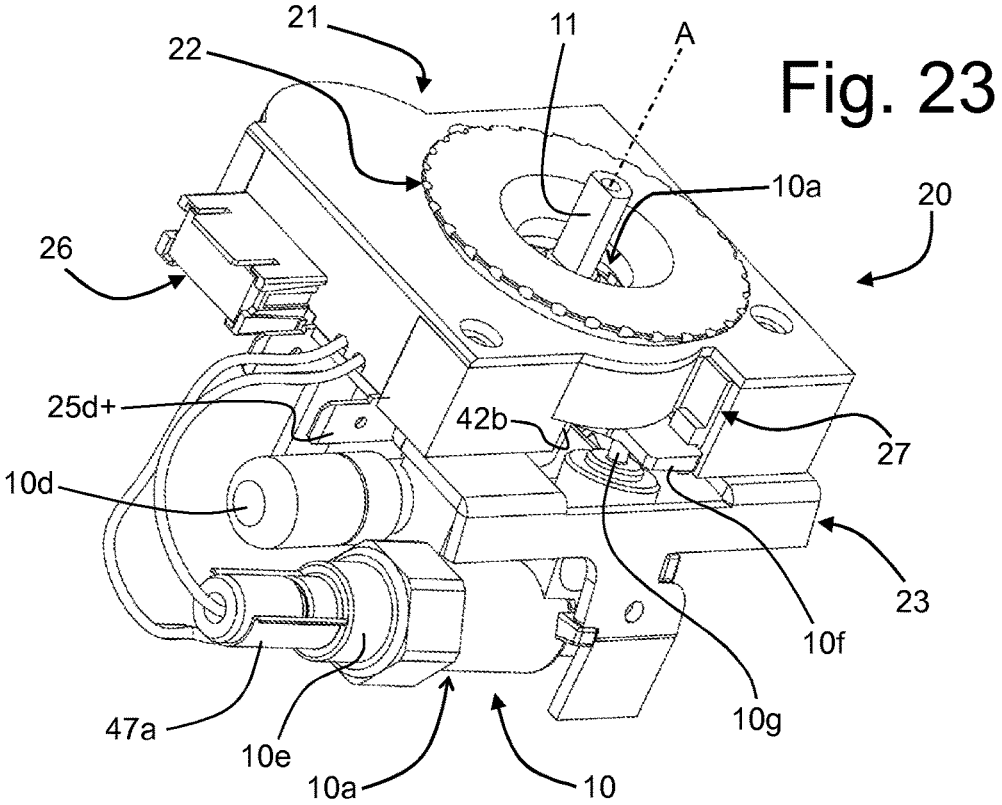
FIG. 23 is a view similar to that of FIG. 7, but with a control knob of a gas tap removed.

FIG. 23 shows the condition of further assembly of the casing 21 on the tap 10, by means of the bracket 23, and with the ring nut 22. It should be noted that FIG. 23—as likewise FIG. 7 described previously where the knob 12 is further represented—is provided merely by way of example given that, in the actual condition where the device 20 is installed, between the ring nut 22 and the casing 21 there extends the wall 3*a* of the appliance 1. FIG. 24 illustrates the device 20 in partial cross section, in this figure there being visible the transmission arrangement formed by the members 28-30 coupled together via the elements 29*b* of the member 29, as well as the gasket 31 set between the ring nut 22 and the front surface of the wall 3*a*.

The presence of the transmission arrangement described prevents the need to associate the manual-control means of the device directly to the corresponding sensor, thereby preventing stresses on the sensor itself and/or on the circuit board on which it is mounted. In this perspective, it is preferable, although not indispensable, for the part of the transmission arrangement to which the ring nut 22 (i.e., the member 29) is associated not to touch in any case the circuit board, but to be supported by a portion of the casing of the device projecting within its cavity (for such a case it is hence also advantageous that the circuit board has a passage for this portion of the casing).

The transmission arrangement envisaged according to the invention provides also a sort of "adapter" between a control means and the corresponding movement-sensor means, and especially between the control means here represented by the ring nut 22 and the sensor means represented by the potentiometer 44. In other words, thanks to a kinematic arrangement of the type considered, a "custom" mechanical arrangement of the device 20 and/or of the control means can be adapted to a sensor of a "standard" type available on the market.

As already clarified, the device 20 is prearranged for performing at least a function of timing of the supply of gas to the burner controlled by the tap 10, and includes for this purpose at least a timer circuit and a means for manual setting of the supply interval, here represented by the ring nut 22, which can be operated from the outside of the structure of the appliance and is substantially coaxial to the knob 12 of the tap 10. In one embodiment, such as the one described previously, the knob 12 and the ring nut 22 can be turned by a user, preferably independently of one another, about the axis A, in order to enable, on the one hand, adjustment of the flow of gas admitted to the burner and, on the other hand, setting of the time of supply of the burner. The knob 12 is also axially movable, unlike the ring nut 22 (on the other hand, as has been mentioned, in possible variant embodiments also the ring nut 22 could translate axially).

Figure 25:
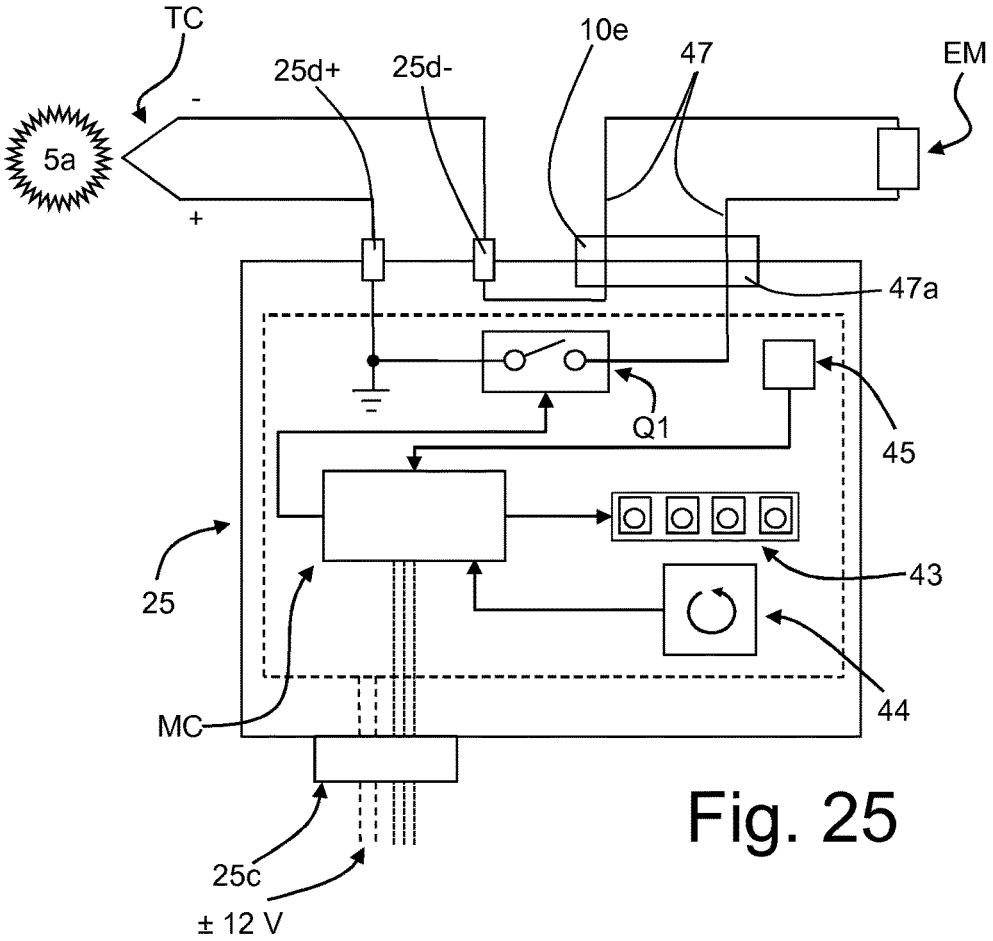
FIG. 25 is a simplified block diagram of a circuit arrangement of a device according to the invention, connected between a thermocouple and the electromagnet of a gas tap.

As represented schematically in FIG. 25, the timer circuit MC is implemented in the circuit arrangement 25, which likewise includes first switching means Q1, which can be controlled for causing interruption of electrical supply to the solenoid EM of the safety valve of the tap 10, upon expiry of the time interval set via the ring nut 22, and thus cause passage of the aforesaid valve into the respective closed condition. For this purpose, the first switching means Q1 are preferably connected in series between the thermocouple TC provided for the tap 10 and the electromagnet EM of the corresponding safety valve.

The timer circuit MC can be obtained in any known way, for example including, in the circuit arrangement 25, a commercially available microcontroller provided with clock or timer function, which can preferably be supplied with a low d.c. voltage (for example 3-12 Vdc) via a supply stage or stabilized power supply. Hence, the device 20 is preferably a low-voltage device. The aforesaid microcontroller MC, in which the program or software for control of the device can be implemented, is connected in signal communication to the position-sensor means, here represented by the potentiometer 44, from which the information regarding the time interval set is obtained.

The first switching means Q1 preferably include at least one switch that can be controlled for opening or varying the electrical circuit of the thermocouple TC, when the time interval in which the burner 5*a* is to remain lit set via the ring nut 22 has elapsed. The controllable switch may be of an electro-mechanical type, for example a relay, or else of an electronic type, for example a MOSFET, and is preferably, but not necessarily, of a normally open type, switchable via a pulse or signal governed by the timer circuit MC. In a preferred embodiment, the switch Q1 is an electronic switch, in particular a MOSFET with extremely low channel resistance, set in series to the thermocouple TC-electromagnet EM circuit. A switch of this sort guarantees, in the case of conduction, an extremely low resistance of the circuit and enables requirements of miniaturization to be met.

According to possible variants, the switching means may include a device or circuit configured for varying the electrical circuit of the thermocouple, for example a load (such as a resistance), which when rendered active, reduces the current to the electromagnet EM.

As has been said, in a preferred, albeit non-exclusive, embodiment of the invention, the device 20 is also prearranged for the purposes of control of a lighter system. The circuit part regarding the lighter system can be obtained in any known way, and is not necessarily implemented in the circuit arrangement 25.

In a variant embodiment not represented, the circuit arrangement 25 of the device can include second control means or controllable switches, which are preferably of higher power than the first switching means Q1, in particular for a 220-V mains supply voltage, in order to control directly a lighter module (for example, for connecting in series two terminals thereof). Also these further switching means, which are preferably of a normally open type, are switchable via a pulse or signal generated by the arrangement 25.

The potentiometer 44, or other component that stands in for it, basically has the function of detecting the position, among a plurality of possible positions, assumed by the manual-control means represented by the ring nut 22, this position representing the duration of the time interval set. As has been said, in a preferred embodiment, the stationary component 44 is constituted by a rotary potentiometer, in particular of a resistive type, preferably of the type designed to be mounted and/or welded directly on a circuit board 25*a*, such as a commercial trimmer, but its functions may be evidently obtained via other electrical and/or electronic components, such as for example optical or magnetic encoders and sensors. The person skilled in the branch will hence appreciate that the actuation element of the sensor means do not necessarily have to be represented by a rotary shaft, such as the shaft 28*b*, it being possible to obtain it with some other type of movable element.

In the example described previously, the emitters 43, which are preferably distributed in a circle around the head portion of the tap 10, bring about lighting-up of the ring nut 22, which is made of transparent plastic material, or in any case a material designed to function as light guide. Also other mechanical parts for transmission of the rotational movement—at least the intermediate member 30 and preferably also the toothed member 29—are preferably made of a similar material, for example polycarbonate, in order to function as optical guide. In this way, the light generated by the emitters 43 is visible from outside the casing 21. The light warnings, generated by the emitters 43 under the control of the timer circuit MC are useful for a user of the device 20. For example:

- a rapidly flashing light may be used to indicate that the device is awaiting programming of the time of supply of the burner;
- a light that stays on may be used to indicate that the device 20 has not been programmed;
- a slowly flashing light may be used to indicate that the device has been programmed and that a cycle of automatic turning-off is in progress;
- a rapidly flashing light may be used to indicate that the end of the supply time is near, and that the flame will be turned off within a few instants.

As already mentioned, in addition or as an alternative, there may also be provided warning means of some other type, for example of an acoustic type, such as the buzzer BZ. In such a case, for example, different acoustic signals may indicate different events, such as confirmation of programming, approach of expiry of the supply time set, effective end of the supply time set.

Figure 26:
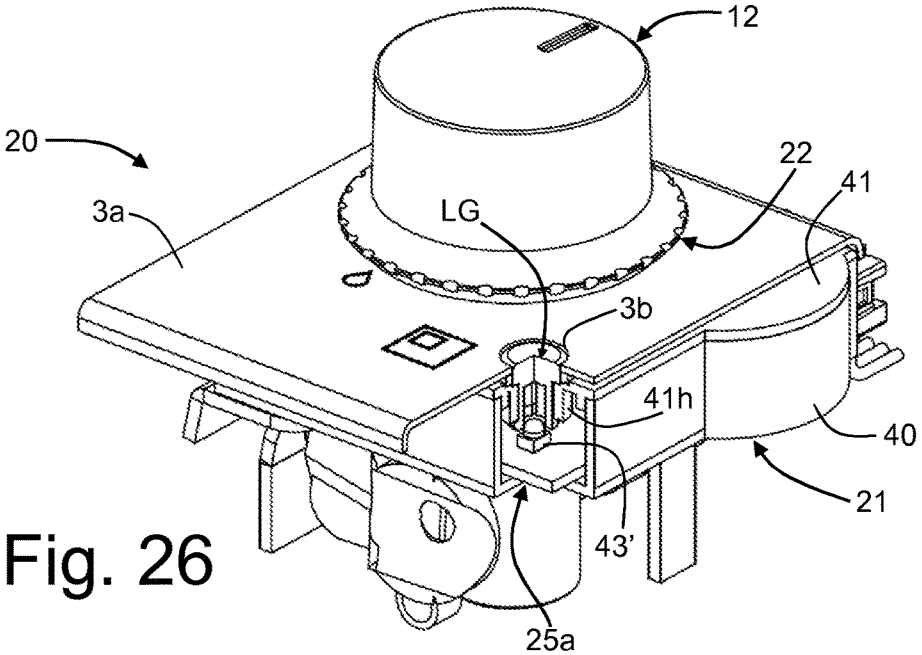
FIG. 26 is a schematic perspective view of a device according to a possible variant of the invention.

FIG. 26 illustrates a variant whereby, in addition or as an alternative to the emitters 43, the circuit arrangement 25 includes at least one emitter 43', associated to which is a stationary light guide LG. In the example, the emitter 43' is directly mounted on the circuit board 25*a* and, in a position corresponding thereto, the lid 41 of the casing defines a positioning seat 41*h* for the light guide LG, which projects or gives out on the outside of the casing 21. In this case, the wall 3*a* defines an opening or window 3*b* for viewing the light guide LG. In other variants (not represented) the light guide LG may be absent, with the emitter 43' mounted or configured so as to project directly on the outside of the casing, within a purposely shaped seat 41*h*, possibly with associated sealing means, such as a perimetral gasket. In other variants (not represented) the light guide LG may extend in the opening or window 3*b* of the wall 3*a*, preferably with further sealing means between the light guide LG and the wall 3*a*, or else there may be provided a further optical guide or transparent element associated in a sealed way to the wall 3*a*. The emitter 43' may also be in a position that is more raised with respect to the plane defined by the circuit board 25*a*, for example by means of its terminals, in which case the light guide LG may have a more contained axial development as compared to the case exemplified. In the limit, the emitter 43' itself could project slightly on the outside of a corresponding hole of the casing 21, in an area corresponding to the window 3*b*.

The control element, here represented by the switch 45, of the circuit arrangement 25 basically has the function of generating the command signal that the microcontroller circuit MC handles for determining or controlling initial closing of the switch Q1 and start-up or otherwise of a time count. The signal generated by the switch 45 can also be used by the arrangement 25, and, in particular, by its microcontroller MC, for generating the switching pulse of the control means associated to the circuit of the lighter system.

Assembly of the device 20 is very simple. Once the casing 21 has been assembled on the bracket 23, the latter is fixed to the body of the corresponding tap 10, already mounted on the part 2 of the structure of the appliance 1. The head portion 10*a* of the tap is thus inserted in the through opening of the casing 21, with the actuation element 10*f* of the tap that is located in a position corresponding to the recess 42*b* of the container 40 (see, for reference, FIGS. 22-23), coupled to the motion-transmission element 27 of the device 20.

The connector 47*a* is connected to the corresponding attachment 10*e* of the tap, whereas the conductors of the thermocouple TC are connected to the blade contacts 25*d* (FIG. 22). After assembly of the part 3 of the structure of the appliance 1, the ring nut 22 is fitted through the through opening 7 of the wall 3*a* of the structure so that its cylindrical bottom portion 22*c* is inserted in the toothed member 29, thus obtaining also coupling between the engagement elements 29*b* and the seats 22*d*. Then coupled to the stem 11 of the tap is the knob 12, on the shank 12*c* of which the element 32 has been previously fitted. The coupling between the stem 11 and the shank 12*c* is configured for enabling removal of the knob 12 and of the ring nut 22 itself by the user, for example for cleaning.

General operation of the device may be at least in part similar to the one described in the document No. WO 2010/134040, to which the reader is referred. In brief, for the purposes of programming of a desired time interval in which the burner 5*a* is to remain lit, the user has to turn the ring nut 22 for setting the desired time, for example ranging between 1 and 120 minutes. The user then turns the knob 12 and presses it in order to bring about initial opening of the safety valve and activation of the gas lighter. The pressure exerted on the knob 12 causes axial displacement of the stem 11 and of the actuation element 10*f*, and hence movement of the motion-transmission element 27, with consequent switching of the control element represented by the switch 45. The signal generated by the switch 45 is used by the control logic of the device 20 for controlling closing of the switching means Q1 provided on the circuit arrangement 25, connected in series between the thermocouple TC and the electromagnet EM of the safety valve, in order to start counting of the time and generate the command signal of the switch associated to the lighter system, when this function is envisaged. Once the burner 5*a* has been lit, the heat generated by the flame causes the thermocouple TC to generate the current necessary to keep the safety valve of the tap 10 open.

At the end of the time interval set via the ring nut 22, the control logic generates a new signal of switching of the switching means Q1, which in this way open the circuit of the electromagnet EM, with consequent closing of the safety valve of the tap 1. The burner is thus turned off once the pre-set time has elapsed.

The device 20 preferably has a predefined position of non-intervention in order to enable normal use of the tap 10 and of the corresponding burner without activation of the timing function. This position may conveniently be represented by an angular position of "zero" of the ring nut 22, which will be purposely provided with suitable indications. When the ring nut 22 is in this position, detected via the transmission arrangement 28-30 and the sensor 44, the functions of the circuit that are associated to the time count will not be active. However, pressure on the knob 12 will cause, in the ways already described above, generation of the signal that determines closing of the switching means in series between the thermocouple and the electromagnet in order to guarantee the electrical continuity necessary for opening the safety valve, and/or will cause generation of a signal for control of the lighter module.

In a different embodiment, the control logic of the device 20 envisages that programming will be carried out by the user after the flame to the burner 5*a* has already been lit. In this case, the user has to carry out lighting of the burner in the way described above (turn the knob 12 and press it, with consequent switching of the switch 45 and activation of the lighter system). Following upon ignition of the flame, the device 20 is activated in a programming mode, signalled, for example, by a fast flashing of the ring nut 22. Next, if within a given time interval the user does not turn the ring nut 22, the supply of gas proceeds in a traditional way (i.e., without timed turning-off), for example with the ring nut 22 lit up continuously via the emitters 43. Instead, in the case where it is desired to program the device 20, the user turns the ring nut 22 and then presses the knob 12 as a confirmation of programming; in this case, the device can signal confirmation of programming (for example, acoustically or with a fast flashing of the ring nut) and start-up of the countdown (with flashing of the ring nut that, for example, becomes slower).

Figure 27:
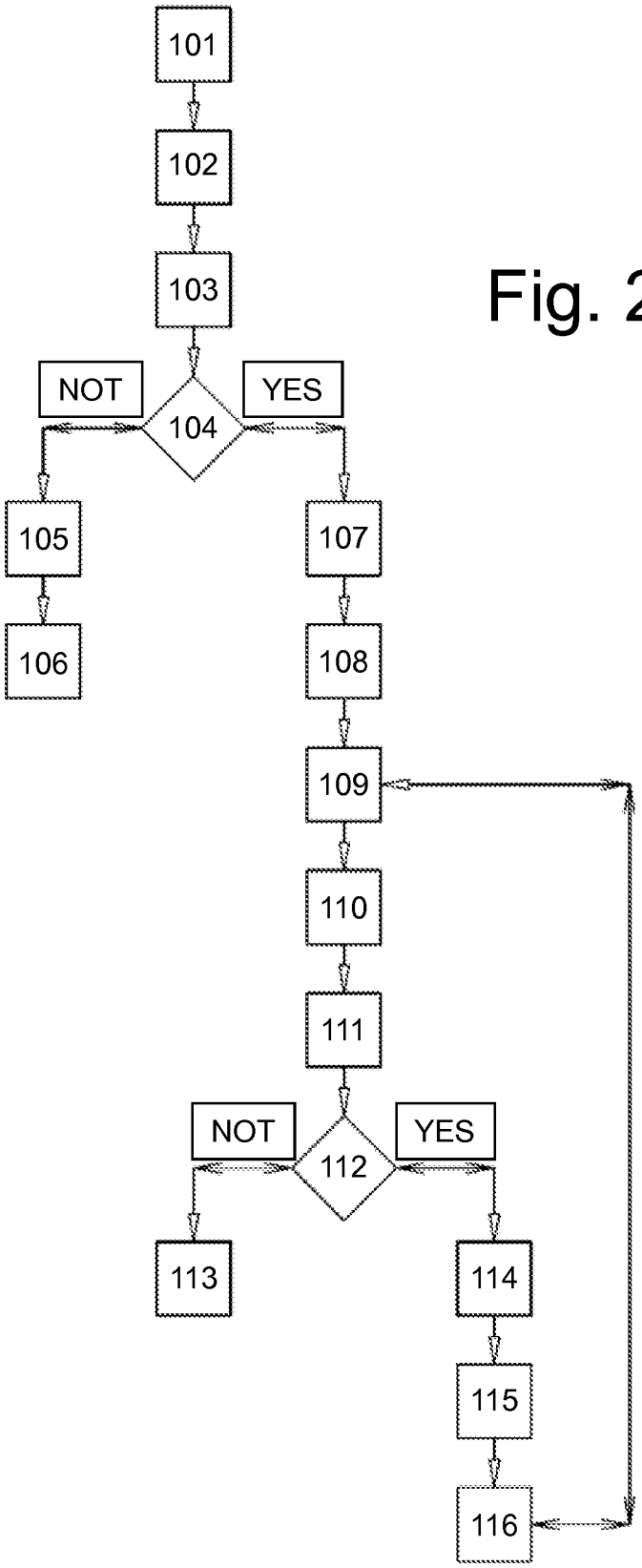
FIG. 27 is a flowchart aimed at exemplifying a possible operating mode of a device according to the invention.
Figure 28:
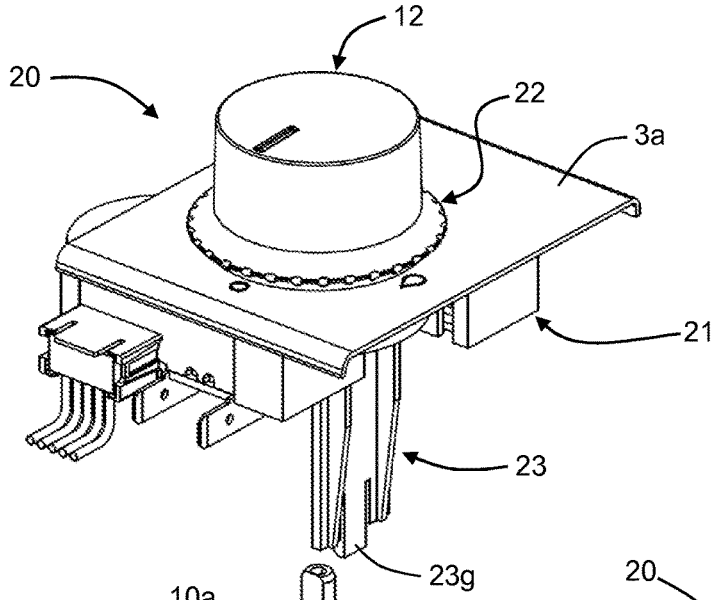
FIG. 28 is a schematic and partially exploded perspective view of a device according to a further possible variant of the invention and of a gas tap.
Figure 29:
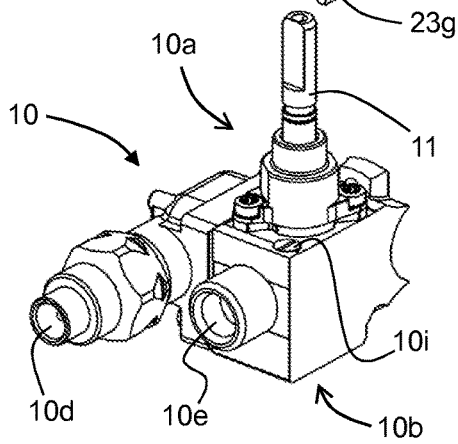
FIG. 29 is a schematic perspective view of the device of FIG. 28, from a rear part thereof.
Figure 29:
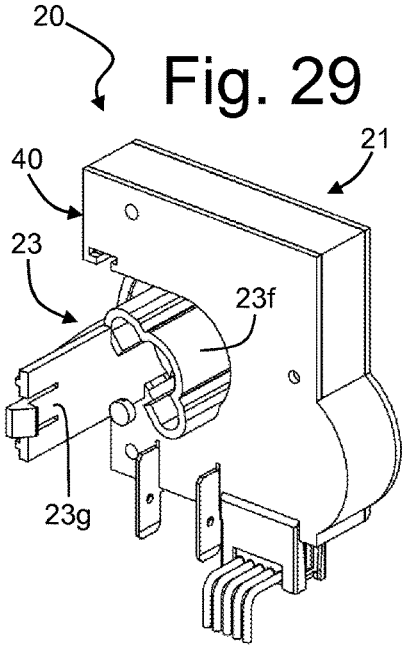

The flowchart of FIG. 27 describes an example of logic of operation of the system forming the subject of the invention, in one embodiment thereof.

Block 101 is the starting block and highlights the condition of flame off and device 20 not programmed, i.e., in a quiescent state. Block 102 represents the step of ignition of the burner, which can be obtained by turning and pressing the knob 12 of the tap 10: rotation enables an initial flow of gas to the burner, whilst pressure exerted on the knob brings about switching of the switch 45, preferably activating a lighter module. Block 103 represents the condition of flame lit on the burner, following upon which the device 20 is activated or can be activated in a programming mode. In a possible embodiment, activation in said mode is determined by switching of the switch 45 (block 102), detected by the control circuit of the device 20. In a preferred embodiment, passage to the programming mode is determined by detection of the effective ignition of the flame, inferred, for example, from the signal generated by the thermocouple. Activation in the programming mode is signalled to the user, for example via a fast flashing of the emitters 43, which can be detected on the ring nut 22. Block 104 is a testing block, with which a check is made to verify whether the user has carried out, within a given time, programming of the device 20 by turning the ring nut 22 beyond the zero position. If he has not (output NO), control passes to block 105, with which the warning mode changes state, for example with the emitters 43 lit up continuously, and then to block 106, with which supply of gas to the burner is made to proceed in a normal way, i.e., without there being established a time of forced extinction. Otherwise (output YES from block 104), control passes to block 107, for detecting the extent of the angular movement of the ring nut 22, and hence the time set by the user, with corresponding indication. The user then confirms programming (block 108), by applying a brief pressure on the knob 12 of the tap, detected by the circuit of the device 20 via switching of the switch 45. Control passes to block 109, for confirmation and notification that programming has been carried out. The notification may be of a visual type, via suitable flashing of the ring nut, and/or acoustic type, if the device is provided, for example, with a buzzer. Control then passes to block 110, with which the timer circuit MC starts countdown of the time of supply of the burner, preferably with a change of state of the warning light, for example, a slow flashing of the emitters 43. Block 111 expresses the fact that a time of forewarning of end of supply of gas to the burner has elapsed, which may depend upon the total time set via the ring nut 22. Once this time of forewarning has elapsed a visual and/or acoustic warning is issued, for example a fast flashing of the emitters 43 and/or a series of frequent beeps generated by the aforesaid buzzer (if present). Control then passes to block 112, which is a testing block, where a check is made to verify whether the user wishes to prolong supply of gas to the burner, via rotation of the ring nut 22 (and/or brief pressure applied on the knob 12). If he does not (output NO), control passes to block 113, where, at the end of the time set via the ring nut 22, the device issues a command for switching of the switching means Q1, causing connection between the thermocouple TC and the electromagnet EM to cease and consequently turning off the flame. Preferably, there is also issued a suitable visual and/or acoustic warning, for example a continuous flashing of the emitters 43 and/or two prolonged beeps separated from one another (if the buzzer is envisaged). The device 20 then sets itself in a quiescent state.

In the case where the user prolongs the supply time (output YES from block 112), control passes to block 114, in which a brief pressure exerted on the knob 12 (and/or rotation of the ring nut 22) is detected. In block 115 the warning for activation of the programming mode is issued, such as a fast flashing of the emitters 43, and the device remains in the wait state, for a given time interval, awaiting further confirmation of programming, for example obtained with a brief pressure exerted on the knob 12 of the tap, detected in block 116. Control then returns to block 109, for confirmation and notification that reprogramming has been carried out.

It is clear that numerous variations may be made by a person skilled in the art to the device described by way of example, without thereby departing from the scope of the invention as defined in the annexed claims. The various characteristics of the various examples may be combined at least in part together to form devices that may even be different from the ones represented and described by way of non-limiting example.

FIGS. 28-33 illustrate further possible variant embodiments. In these figures the same reference numbers as those of the previous figures are used to designate elements that are technically equivalent to the ones already represented. In the example represented, the tap 10 has a general configuration different from that of the previous figures, but the basic characteristics of the invention remain unchanged. In these figures, also the type of the means for coupling of the casing 21 to the body of the gas tap is different. In this case, these coupling means comprise at least one part 23, which projects downwards from the casing 21 (here from the container 40), in a direction preferably substantially axial and parallel to the axis of the passage (42) that receives part of the tap 10.

The coupling part 23 preferably includes at least one member 23*g* for engagement to the body of the tap 10, in particular in an area of the rear portion 10*b* of the tap. The engagement member 23*g* may include, as in the example, an elastically deformable tab, defined on which is a tooth (visible in FIG. 29) designed to engage with the body of the tap 10. For this purpose, the part 23 may, for example, be made of plastic and/or metal material. In one embodiment, and as may be seen in FIG. 29, the part 23 comprises a generally tubular initial stretch 23*f*, in the proximity of the passage 42 of the casing, so as to gird at least part of the body of the tap 10 in order to improve further the positioning between the device and the tap. The part 23 may also be made of a single piece with a part of the casing 21, such as the container 40, or else fixed thereto, for example via screws or the like, or else again a part of the casing 21 may be overmoulded on the part 23, whether this be made of plastic or metal material.

As has been said, in the case exemplified in FIGS. 28-33, the tap 10 has a structure different from the one described previously, and here is without the actuation element 10*f* and the shaft 10*g*. Hence, in such an application, the device 20 may not perform the function of control of a lighter system. Obviously, in other possible embodiments, to the rod 11 of the tap of FIGS. 28-29 which in any case can translate axially there may be associated an element performing the functions of the element previously designated by 10*f*.

FIGS. 28-33 illustrate also a further variant of the invention, aimed at enabling functional calibration of the gas tap. It should be pointed out, for this purpose, that some gas taps envisage, in particular, in the front area of their body close to the rod 11, an adjustment element, typically a screw member, for example for the so-called "minimum flame" adjustment or adjustment of the flame in relation to the type of gas. In an advantageous embodiment, the device according to the invention is configured for enabling a convenient access to said adjustment element, even without the need to separate the casing 21 from the body of the tap and/or from the structure of the appliance 1. In the case exemplified, the tap 10 of FIG. 28 has an adjustment element of this sort, represented by a screw member 10*i*, generally parallel to the rod 11 and accessible from the front 10*a* of the body of the tap 10, in particular, via the opening 7 (see, for reference, FIG. 2) of the appliance 1.

For this reason, at least one of the casing of the device and at least an internal element of the device and/or of the transmission arrangement of the device is configured for enabling a convenient accessibility to said member 10*i*, for example via a screwdriver or similar tool.

Preferably, part of the casing, for example at least its lid 41, can be configured for this purpose. In the non-limiting example illustrated, and as may be seen in FIGS. 30-31, for example, the lid 41 has a recess 41*i*, having a generally semicircular or at least in part circular profile, which is defined radially with respect to its through opening 41*a*.

Figure 30:
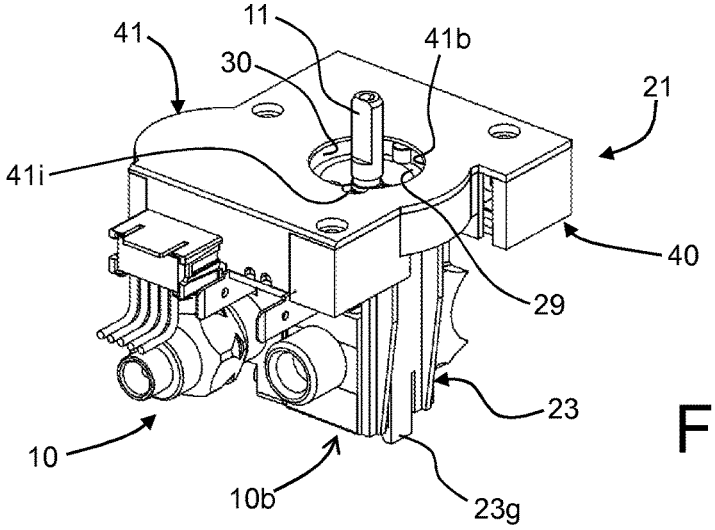
FIGS. 30 and 31 are two perspective views of a part of the device of FIGS. 28-29, with some components removed.
Figure 31:
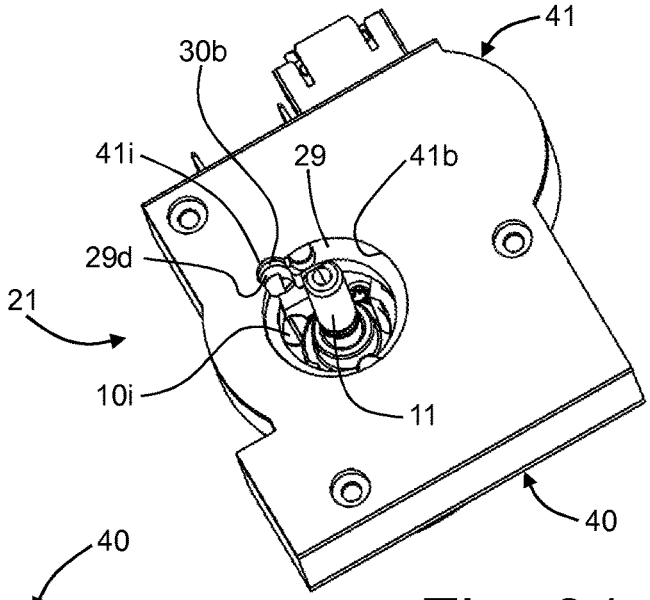
Figure 32:
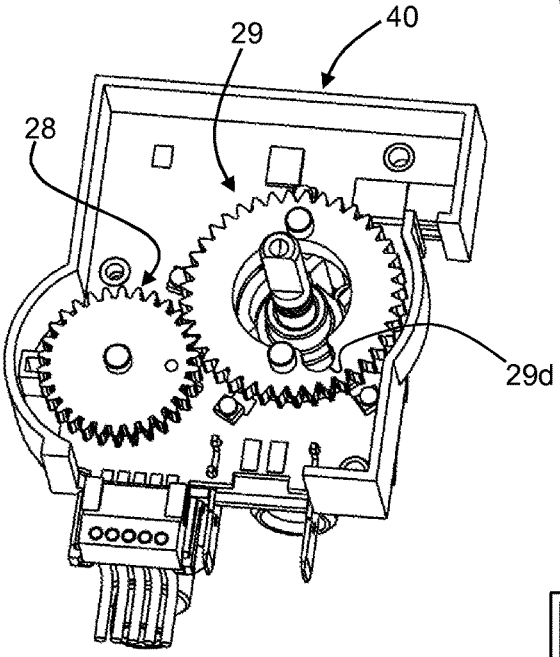
FIGS. 32 and 33 are a perspective view and a plan view of the device of FIGS. 28-31, with further components removed.

FIGS. 30-31—where the representation of the knob 12 and of the ring nut 22 has been omitted—show a possible embodiment whereby the members 29 and 30 are provided, in a radial position of the corresponding axial cavities, with respective axial recesses, which have a preferably semicircular or at least in part circular profile, designated by 29*d* and 30*b*. The recess 29*d* may be clearly seen in FIGS. 32-33, where also the representation of the lid 41 and of the member 30 has been omitted. Given that the members 29 and 30 are coupled together (by means of the engagement elements 29*b*—see, for example, FIG. 20), the recesses 29*d* and 30*b* are defined on the members themselves in corresponding and axially aligned positions.

Figure 33:
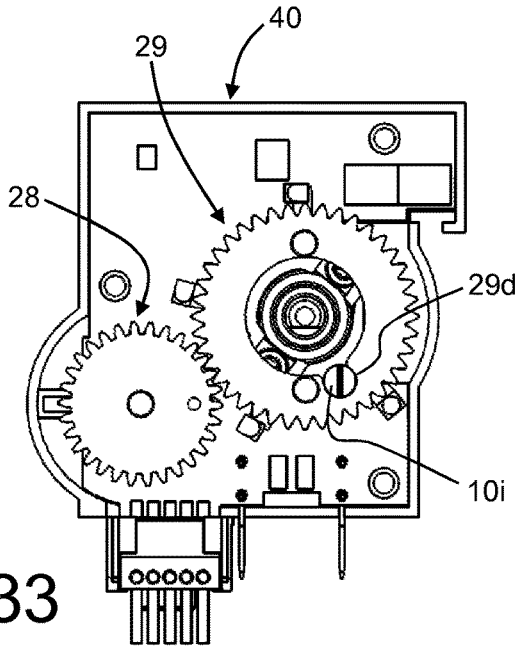

As may be appreciated, for example from FIG. 33, also thanks to the presence of the passage that traverses the casing 21, and especially the passage 42 of its container 40, the members 29 and 30 (which are coupled together in motion) can be brought to assume an angular position in which the corresponding recesses 29*d* and 30*b* are axially aligned to the head of the screw member 10*i*. Preferably, said angular position is predefined and corresponds to the "zero" position of the ring nut 22, i.e., the position of non-intervention of the device 20.

For example, starting from the assembled condition, and in the case where it is necessary to carry out an adjustment of the member 10*i*, the operator simply has to bring the ring nut 22 into the corresponding zero position, where the recesses 29*d* and 30*b* of the members 29 and 20 are axially aligned to the screw member 10*i*. Next, the knob 12 of the tap 10 and the ring nut 22 can be removed, as illustrated in FIGS. 30-31. Through the opening 7 (see, for reference, FIG. 2) of the wall 3*a* of the appliance and the recess 41*i* of the lid 41 (if said recess is provided), the head of the adjustment member 10*i* is accessible from the outside of the structure of the appliance 1. Of course, when present, the recess 41*i* of the lid 41 will be in a position axially corresponding to that of the screw member 10*i*.

In other embodiments (not represented), a passage aimed at enabling access to a member for adjustment or calibration of the gas tap may be defined in some other position, not necessarily coinciding with the passage 42, for example a circular passage, involving, for example, also the circuit board 25*a* and/or the member 28. In one embodiment, the body 40 and the lid 41 may be shaped so as to have two tubular elements facing the inside of the casing 21, which fit to their facing ends to form a single passage duct, preferably a closed duct inside the casing 21, for reasons of protection and/or hermetic seal. In such an embodiment, the circuit board 25*a* can have a through hole in a position corresponding to one of said tubular elements.

Of course, the variants described with reference to FIGS. 28-33 may be implemented also in the devices described with reference to FIGS. 1-26.

In the embodiments previously exemplified, to one and the same control element 45 there are associated both activation of the lighter system, and the functions of the device 20 linked to timing, but it is clear that even a number of control elements may be provided, such as two separate contacts or switches. In such a variant, for example, the control element connected to the timing can be switched via the ring nut 22, which in this case will be mounted axially movable. As already mentioned, moreover, the device 20 may not perform functions linked to lighting of the burner.

Previously reference has been made to the use of control means, amongst which the switch Q1, designed to modify the state of the electrical connection between the electrical-connection means 47 and 25*d*, i.e., to open the thermocouple-solenoid electrical circuit when the time interval set via the ring nut 22 has elapsed. As has already been mentioned, according to possible variants, the control means may be prearranged for modifying the state of the connection referred to above, without necessarily opening the aforesaid circuit, but simply varying it (for example, by inserting in parallel to the thermocouple a load or a resistance that reduces the current to the solenoid).

In the embodiments described previously, the means for detecting the movement of the ring nut 22, associated to the transmission arrangement, are represented by a rotary potentiometer or trimmer, but in possible variants it is possible to provide a linear potentiometer, with a movement of the corresponding movable part along a respective axis, in particular orthogonal to the axis A, for example envisaging a pinion-and-rack transmission system. The rotary potentiometer previously described has a seat engaged in which is the element 28*b* of the member 28, whereas in the case of a linear potentiometer this would preferably have a slider in relief, operatively coupled—for example—to a rack element engaged to a toothing of the member 28, which functions in this case as pinion.

As an alternative to what has been explained previously, the device 20 could even comprise only just some of the parts or functions described above.

The invention claimed is:

1. A gas appliance control device, for appliances that comprise at least one gas tap having a safety valve that includes an electromagnet to be supplied with an electric current generated by a thermo-electric generator, wherein the gas appliance control device comprises:

a manual-control member movable or rotatable with respect to a first axis for setting a time interval;

a circuit arrangement that includes:

a control element, first electrical-connection means, configured for connection to an electromagnet of a safety valve, second electrical-connection means, configured for connection to a thermo-electric generator, a sensor device, configured for detecting movements of the manual-control member and supplying corresponding signals to the control element, the sensor device including a movable part configured to be set in motion following upon a movement of the manual-control member;

a supporting structure, configured to be associated in a stationary way with respect to a gas tap, the supporting structure being designed to be housed at least in part within a body of a gas appliance;

wherein the control element is configured for modifying a state of an electrical connection between the first electrical-connection means and the second electrical-connection means upon expiry of said time interval;

wherein at least one of the manual-control member and the supporting structure defines at least part of a passage adapted to receive a corresponding part of the gas tap;

wherein the movable part of the sensor device is movable or rotatable with respect to a second axis; and wherein operatively set between the manual-control member and the movable part of the sensor device is a transmission arrangement.

2. The device according to claim 1, wherein the transmission arrangement comprises a first transmission member, which is substantially coaxial to the manual-control member and is configured to move or turn therewith.

3. The device according to claim 2, wherein the transmission arrangement includes at least one second transmission member, which is engaged in motion with the first transmission member and is configured to set in motion the movable part of the sensor device.

4. The device according to claim 3, wherein at least one of the second transmission member and the movable part of the sensor device is rotatable about the second axis, which is substantially parallel to the first axis.

5. The device according to claim 3, wherein the movable part of the sensor device includes an element integral with, or fixed in motion with respect to, the second transmission member.

6. The device according to claim 2, wherein the first transmission member is rotatably supported by a corresponding portion of a casing of the supporting structure at said passage.

7. The device according to claim 2, wherein the first transmission member has an axial cavity adapted to receive a corresponding part of the gas tap, the axial cavity of the first transmission member defining at least one respective part of said passage.

8. The device according to claim 2, wherein the transmission arrangement includes an intermediate member that is operatively set between the manual-control member and the first transmission member, to move or turn therewith according to the first axis.

9. The device according to claim 8, wherein in an axial cavity of the intermediate member there is at least partially received, in a separable way, a cylindrical portion of the manual-control member.

10. The control device according to claim 8, wherein the intermediate member is juxtaposed with respect to the first transmission member and has an outer diameter larger than an outer diameter of the first transmission member, in such a way that a peripheral annular region of an end face of the intermediate member faces one or more light-emitters, and wherein the intermediate member is made of a material designed to transmit light generated by the one or more light-emitters.

11. The device according to claim 2, wherein:

the manual-control member has a cylindrical portion for engagement with the first transmission member; and from one face of the first transmission member generally set facing the manual-control member there rise engagement elements, configured to be fitted in respective first axial recesses defined in an outer surface of said cylindrical portion of the manual-control member.

12. The device according to claim 11, wherein at least one of a casing of the supporting structure and one element internal to said casing is configured for enabling access to an adjustment member provided in an external region of the gas tap.

13. The device according to claim 11, wherein the engagement elements comprise at least two appendages, which are substantially cylindrical and are set in diametrically opposite positions, and the first axial recesses have a substantially semi-cylindrical profile.

14. The device according to claim 11, wherein:

the transmission arrangement includes an intermediate member that is operatively set between the manual-control member and the first transmission member, to move or turn therewith according to the first axis;

in an axial cavity of the intermediate member there is at least partially received, in a separable way, said cylindrical portion of the manual-control member; and the intermediate member has, at a surface of the corresponding axial cavity, second axial recesses for coupling with said engagement elements of the first transmission member.

15. The device according to claim 2, wherein the manual-control member is coupled in a separable way to the first transmission member.

16. The device according to claim 1, wherein the circuit arrangement comprises a circuit board having a respective opening at said passage.

17. The device according to claim 1, wherein the circuit arrangement includes light-emitting means.

18. The device according to claim 17, wherein the light-emitting means comprise at least one from among:

one or more light emitters operatively arranged within a casing of the supporting structure;

one or more light emitters arranged in the proximity of said passage; and a plurality of light emitters operatively arranged according to a circular or arched shape.

19. The control device according to claim 1, further comprising a motion-transmission element configured for transmitting an axial movement of a control rod of the gas tap to a switching element of the circuit arrangement.

20. A gas appliance, comprising a gas appliance control device according to claim 1, wherein the gas appliance comprises at least one gas tap for control of the supply of gas to a burner, the gas appliance having a body, partially housed within which is the gas tap, the body having at least one passage in a position corresponding to the gas tap, wherein the supporting structure of the gas appliance control device is substantially housed within the body with the manual-control member that project at least partially on the outside of the body through the said opening.

* * * * *